US010118424B2

(12) United States Patent
Samoto

(10) Patent No.: US 10,118,424 B2
(45) Date of Patent: Nov. 6, 2018

(54) INKJET PRINTER, AND METHOD AND COMPUTER-READABLE MEDIUM THEREFOR

(71) Applicant: BROTHER KOGYO KABUSHIKI KAISHA, Nagoya, Aichi (JP)

(72) Inventor: Kenji Samoto, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/473,829

(22) Filed: Mar. 30, 2017

(65) Prior Publication Data

US 2017/0282620 A1 Oct. 5, 2017

(30) Foreign Application Priority Data

Mar. 31, 2016 (JP) ..... 2016-073022

(51) Int. Cl.

| | |
|---|---|
| ***B41J 29/393*** | (2006.01) |
| ***B41J 13/00*** | (2006.01) |
| ***B41J 11/00*** | (2006.01) |
| ***B65H 1/26*** | (2006.01) |
| ***B65H 3/06*** | (2006.01) |

(Continued)

(52) U.S. Cl.

CPC ..... *B41J 29/393* (2013.01); *B41J 11/008* (2013.01); *B41J 13/0018* (2013.01); *B41J 13/0027* (2013.01); *B41J 29/13* (2013.01); *B41J 29/38* (2013.01); *B65H 1/266* (2013.01); *B65H 3/0684* (2013.01); *B65H 5/062* (2013.01); *B65H 7/00* (2013.01); *B65H 9/006* (2013.01)

(58) Field of Classification Search

CPC ..... B41J 2/04506; B41J 2/04505; B41J 2/04503; B41J 2/04501; B41J 2/04508; B41J 2/0451; B41J 2/04511; B41J 2/04513; B41J 2/04515; B41J 2/04516; B41J 2/04518; B41J 2/0453; B41J 2/04528; B41J 2/04526; B41J 2/04525

See application file for complete search history.

(56) References Cited

U.S. PATENT DOCUMENTS 6,702,274 B1 3/2004 Otsuka

FOREIGN PATENT DOCUMENTS

| | | |
|---|---|---|
| JP | 2001-039552 A | 2/2001 |
| JP | 2003-072964 A | 3/2003 |
| JP | 2013-112450 A | 6/2013 |

*Primary Examiner* — Kristal Feggins

(74) *Attorney, Agent, or Firm* — Scully, Scott, Murphy & Presser, P.C.

(57) ABSTRACT

An inkjet printer includes a controller configured to perform an intermittent conveyance process including controlling a conveyor to intermittently convey a preceding sheet, an image recording process including controlling a recording head to perform image recording for each single pass on the preceding sheet while controlling a carriage moving mechanism to move a carriage with the recording head mounted thereon over each single pass in a direction along a scanning direction, a remaining-pass calculating process including calculating a count of remaining passes to be recorded on the preceding sheet, and a feeding process including, in response to the calculated count of the remaining passes being a particular number, controlling a feeder to start feeding a subsequent sheet at a point of time when a first particular period of time elapses from a next timing to start conveyance of the preceding sheet in the intermittent conveyance process.

19 Claims, 11 Drawing Sheets

(51) Int. Cl.

| | |
|---|---|
| ***B65H 5/06*** | (2006.01) |
| ***B65H 7/00*** | (2006.01) |
| ***B65H 9/00*** | (2006.01) |
| ***B41J 29/13*** | (2006.01) |
| ***B41J 29/38*** | (2006.01) |

INKJET PRINTER, AND METHOD AND COMPUTER-READABLE MEDIUM THEREFOR

CROSS-REFERENCE TO RELATED APPLICATION

This application claims priority under 35 U.S.C. § 119 from Japanese Patent Application No. 2016-073022 filed on Mar. 31, 2016. The entire subject matter of the application is incorporated herein by reference.

BACKGROUND

Technical Field

The following description relates to aspects of an inkjet printer, a method, and a computer-readable medium for performing image recording on recording sheets by an inkjet system.

Related Art

An inkjet printer has been known that is configured to convey a preceding sheet along a conveyance path in an intermittent manner to alternately repeat conveyance and stop of the preceding sheet, and convey a subsequent sheet along the conveyance path in a continuous manner not to stop the subsequent sheet while keeping a short distance from the preceding sheet. Further, the known inkjet printer is configured to acquire the distance between the preceding sheet and the subsequent sheet, and adjust a conveyance speed for the subsequent sheet depending on the acquired distance.

SUMMARY

The known inkjet printer halts the conveyance of the preceding sheet during a period in which the printer is performing image recording on the preceding sheet. Therefore, when the distance between the two sheets becomes shorter in response to the conveyance of the preceding sheet being stopped, the printer is required to perform complicated control to frequently change the conveyance speed for the subsequent sheet. Further, when the conveyance speed for the subsequent sheet is changed, it might cause noises and/or feeding failures.

Aspects of the present disclosure are advantageous to provide one or more improved techniques, for an inkjet printer, which make it possible to convey a preceding sheet and a subsequent sheet while keeping an appropriate short distance between the two sheets.

According to aspects of the present disclosure, an inkjet printer is provided that includes a tray configured to support a plurality of sheets placed thereon, a feeder configured to feed each sheet from the tray to a conveyance path, a conveyor configured to convey each sheet in a conveyance direction along the conveyance path, a recording head configured to discharge ink droplets onto each sheet conveyed by the conveyor, a carriage configured to reciprocate along a scanning direction with the recording head mounted thereon, the scanning direction being perpendicular to the conveyance direction, a carriage moving mechanism configured to move the carriage along the scanning direction, a storage configured to store image data to be recorded on each sheet, and a controller. The controller is configured to perform an intermittent conveyance process including controlling the conveyor to intermittently convey a preceding sheet by alternately repeating conveyance and stop of the preceding sheet, an image recording process including controlling the recording head to perform image recording for each single pass on the preceding sheet by discharging ink droplets onto the preceding sheet while controlling the carriage moving mechanism to move the carriage over each single pass in a single direction along the scanning direction, based on the image data stored in the storage, in the intermittent conveyance process, a remaining-pass calculating process including calculating a count of remaining passes to be recorded on the preceding sheet in the image recording process, based on the image data stored in the storage, and a feeding process including, in response to the calculated count of the remaining passes being a particular number, controlling the feeder to start feeding a subsequent sheet from the tray at a point of time when a first particular period of time elapses from a next timing to start conveyance of the preceding sheet in the intermittent conveyance process.

According to aspects of the present disclosure, further provided is a method implementable on a processor coupled with an inkjet printer including a tray, a feeder, a conveyor, a carriage, a recording head mounted on the carriage, a carriage moving mechanism, and a storage. The method includes performing an intermittent conveyance process including controlling the conveyor to intermittently convey a preceding sheet in a conveyance direction by alternately repeating conveyance and stop of the preceding sheet, performing an image recording process including controlling the recording head to perform image recording for each single pass on the preceding sheet by discharging ink droplets onto the preceding sheet while controlling the carriage moving mechanism to move the carriage over each single pass in a single direction along a scanning direction, based on image data stored in the storage, in the intermittent conveyance process, the scanning direction being perpendicular to the conveyance direction, performing a remaining-pass calculating process including calculating a count of remaining passes to be recorded on the preceding sheet in the image recording process, based on the image data stored in the storage, and performing a feeding process including, in response to the calculated count of the remaining passes being a particular number, controlling the feeder to start feeding a subsequent sheet from the tray at a point of time when a first particular period of time elapses from a next timing to start conveyance of the preceding sheet in the intermittent conveyance process.

According to aspects of the present disclosure, further provided is a non-transitory computer-readable medium storing computer-readable instructions that are executable on a processor coupled with an inkjet printer including a tray, a feeder, a conveyor, a carriage, a recording head mounted on the carriage, a carriage moving mechanism, and a storage. The instructions are configured to, when executed by the processor, cause the processor to perform an intermittent conveyance process including controlling the conveyor to intermittently convey a preceding sheet in a conveyance direction by alternately repeating conveyance and stop of the preceding sheet, an image recording process including controlling the recording head to perform image recording for each single pass on the preceding sheet by discharging ink droplets onto the preceding sheet while controlling the carriage moving mechanism to move the carriage over each single pass in a single direction along a scanning direction, based on image data stored in the storage, in the intermittent conveyance process, the scanning direction being perpendicular to the conveyance direction, a remaining-pass calculating process including calculating a count of remaining passes to be recorded on the preceding sheet in the image recording process, based on the image data stored in the storage, and a feeding process including, in response to the calculated count of the remaining passes being a particular number, controlling the feeder to start feeding a subsequent sheet from the tray at a point of time when a first particular period of time elapses from a next timing to start conveyance of the preceding sheet in the intermittent conveyance process.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an illustrative embodiment according to aspects of the present disclosure will be described with reference to the accompanying drawings.

[Overall Configuration of MFP]

Figure 1:
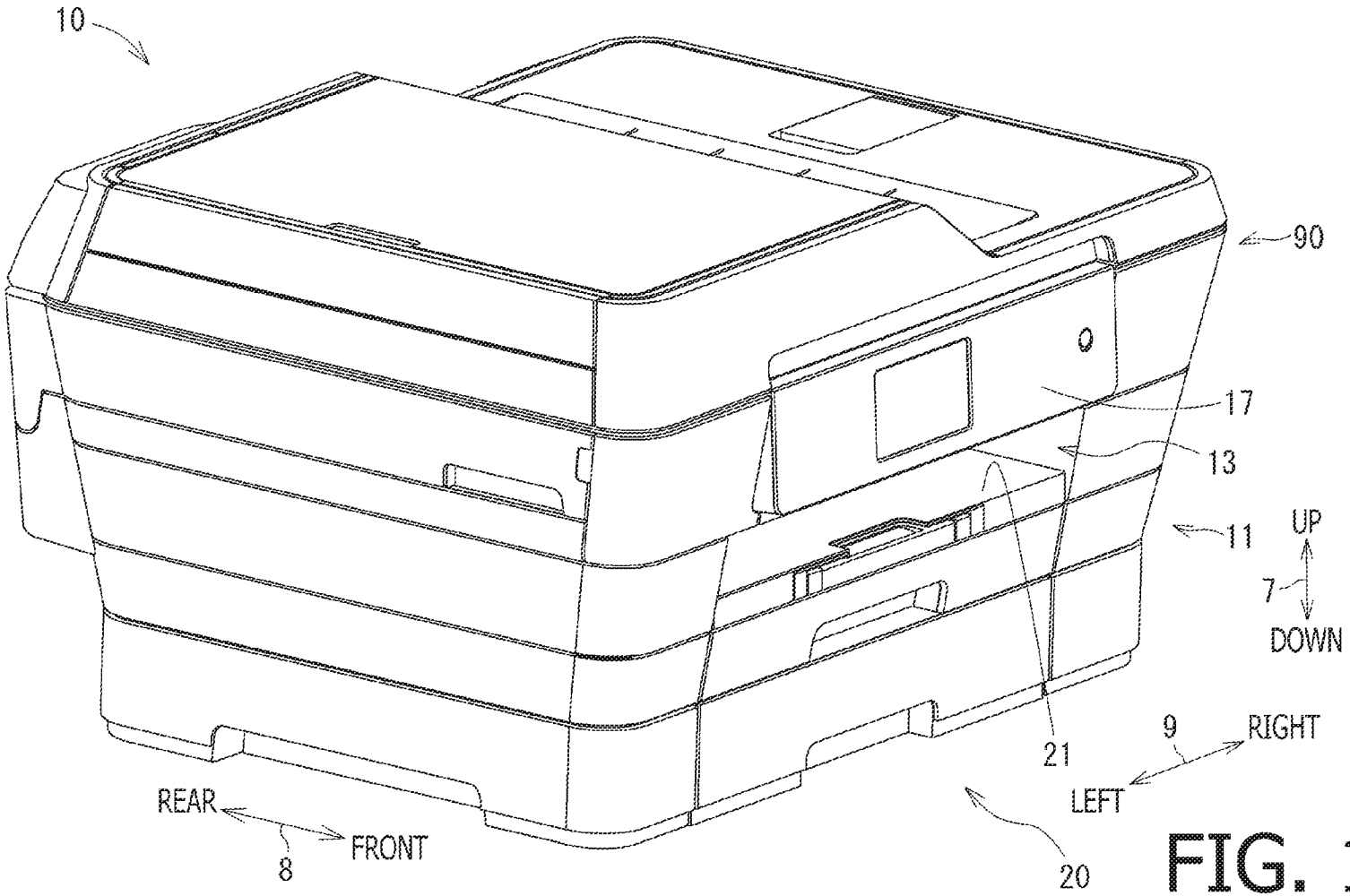
FIG. 1 is a perspective view of a multi-function peripheral (hereinafter referred to as an "MFP") in an illustrative embodiment according to one or more aspects of the present disclosure.

As shown in FIG. 1, a multi-function peripheral (hereinafter referred to as an "MFP") 10 is substantially formed in a rectangular parallelepiped. The MFP 10 includes a printer 11 and an image scanner 90.

[Printer]

Figure 2:
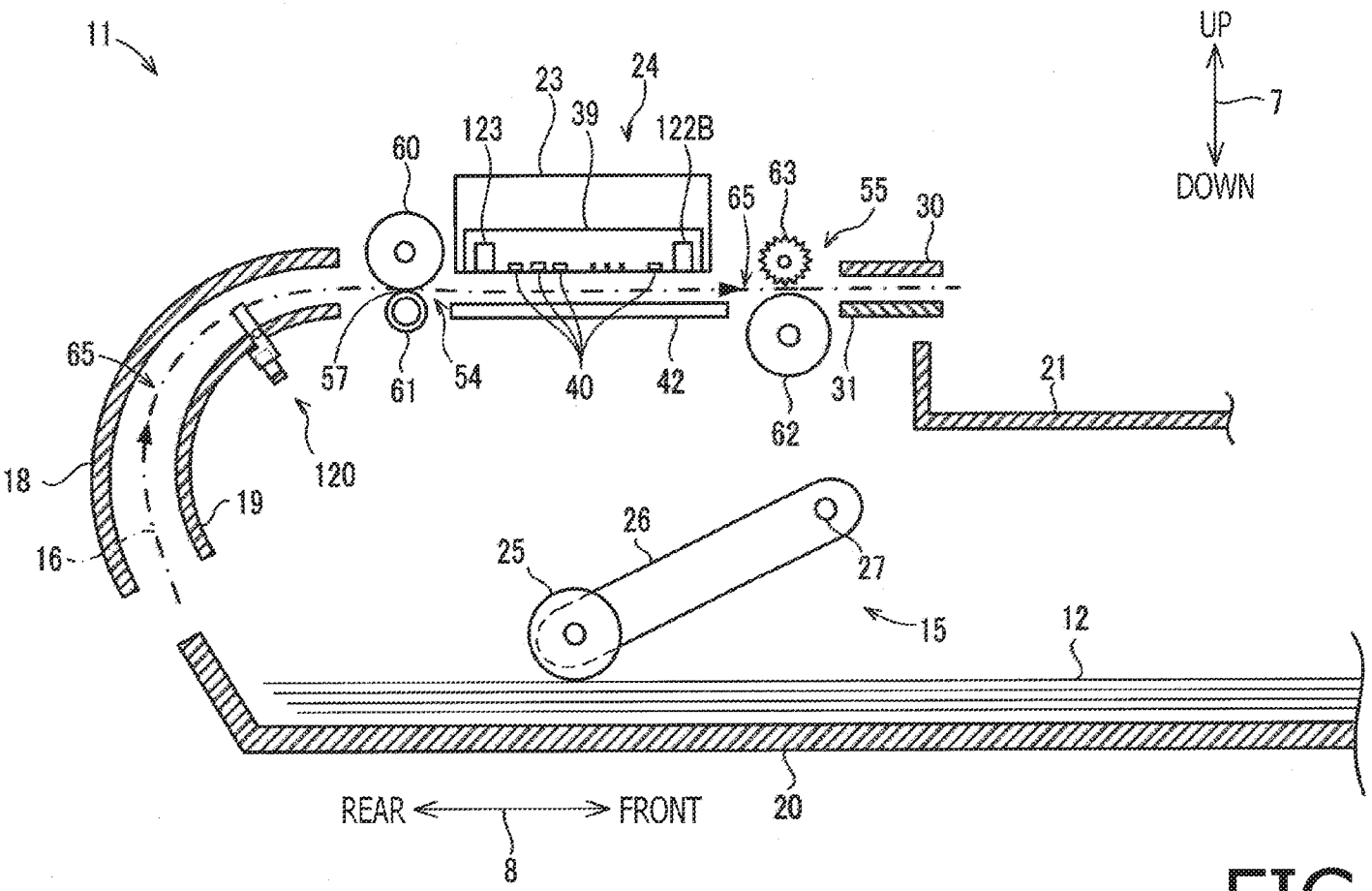
FIG. 2 is a cross-sectional side view schematically showing an internal configuration of a printer included in the MFP in the illustrative embodiment according to one or more aspects of the present disclosure.

The printer 11 is configured to record an image represented by image data on a recording sheet 12 (see FIG. 2) in an inkjet method to discharge ink droplets onto the recording sheet 12. As shown in FIG. 2, the printer 11 includes a sheet feeder 15, a feed tray 20, a discharge tray 21, a conveyance roller unit 54, an image recorder 24, a discharge roller unit 55, and a platen 42.

[Feed Tray and Discharge Tray]

At a front side of the printer 11, an opening 13 (see FIG. 1) is formed. Through the opening 13, the feed tray 20 is inserted into and pulled out from the printer 11. The feed tray 20 is configured to support a stack of recording sheets 12 placed thereon. The discharge tray 21 is configured to support recording sheets 12 discharged by the discharge roller unit 55 via the opening 13.

[Sheet Feeder]

As shown in FIG. 2, the sheet feeder 15 includes a pickup roller 25, a pickup arm 26, and a shaft 27. The pickup roller 25 is rotatably supported at an end portion of the pickup arm 26. By forward rotation of a feed motor 101 (see FIG. 3), the pickup roller 25 is rotated in a rotational direction (hereinafter referred to as a "forward rotational direction") to convey a recording sheet 12 in a conveyance direction 16. The pickup arm 26 is swingably supported by the shaft 27. The shaft 27 is supported by a frame of the printer 11. The pickup arm 26 is rotated and urged toward the feed tray 20 by a weight of the pickup arm 26 and/or an elastic force from an elastic member (e.g., a spring).

[Conveyance Path]

The conveyance path 65 is a space defined by guide members 18, 30, 19, and 31. The guide member 18 and the guide member 19 are opposed to each other with a gap of a particular distance therebetween. Likewise, the guide member 30 and the guide member 31 are opposed to each other with a gap of a particular distance therebetween. The conveyance path 65 extends from a rear end portion of the feed tray 20 toward a rear portion of the printer 11. Further, at the rear portion of the printer 11, the conveyance path 65 extends upward from a lower portion of the printer 11. Then, the conveyance path 65 extends in a U-turn manner and further extends to the discharge tray 21 via the image recorder 24. The conveyance direction 16 of the recording sheet 12 along the conveyance path 65 is shown by an alternate long and short dash line arrow in FIG. 2.

[Conveyance Rollers]

The conveyance roller unit 54 are disposed upstream of the image recorder 24 in the conveyance direction 16. The conveyance roller unit 54 include a conveyance roller 60 and a pinch roller 61 disposed to face each other. The conveyance roller 60 is driven by a conveyance motor 102 (see FIG. 3). The pinch roller 61 is rotated in accordance with rotation of the conveyance roller 60. The recording sheet 12 is conveyed in the conveyance direction 16 while being pinched between the conveyance roller 60, which is driven in a forward rotational direction by the conveyance motor 102 rotating forward, and the pinch roller 61. Further, the conveyance roller 60 is configured to be driven in a backward rotational direction by the conveyance motor 102 rotating backward. The backward rotational direction is opposite to the forward rotational direction. Hereinafter, a position in a front-to-rear direction 8 where the conveyance roller 60 is in pressure contact with the pinch roller 61 may be referred to as a nip position 57.

[Discharge Rollers]

The discharge roller unit 55 are disposed downstream of the image recorder 24 in the conveyance direction 16. The discharge roller unit 55 includes a discharge roller 62 and a spur roller 63 disposed to face each other. The discharge roller 62 is driven by the conveyance motor 102. The spur roller 63 is rotated in accordance with rotation of the discharge roller 62. The recording sheet 12 is conveyed in the conveyance direction 16 while being pinched between the discharge roller 62, which is driven in a forward rotational direction by the conveyance motor 102 rotating forward, and the spur roller 63.

[Registration Sensor]

As shown in FIG. 2, the printer 11 includes a registration sensor 120. The registration sensor 120 is disposed upstream of the conveyance roller unit 54 in the conveyance direction 16. The registration sensor 120 outputs different detection signals depending on whether there is a recording sheet 12 in a detectable position of the sensor 120. Specifically, when there is a recording sheet 12 in the detectable position, the registration sensor 120 transmits a high-level signal to a below-mentioned controller 130 (see FIG. 3) (i.e., the registration sensor 120 is in an ON state). Meanwhile, when there is not a recording sheet 12 in the detectable position, the registration sensor 120 transmits a low-level signal to the controller 130 (i.e., the registration sensor 120 is not in the ON state).

[Rotary Encoder for Sheet Feeder]

Figure 3:
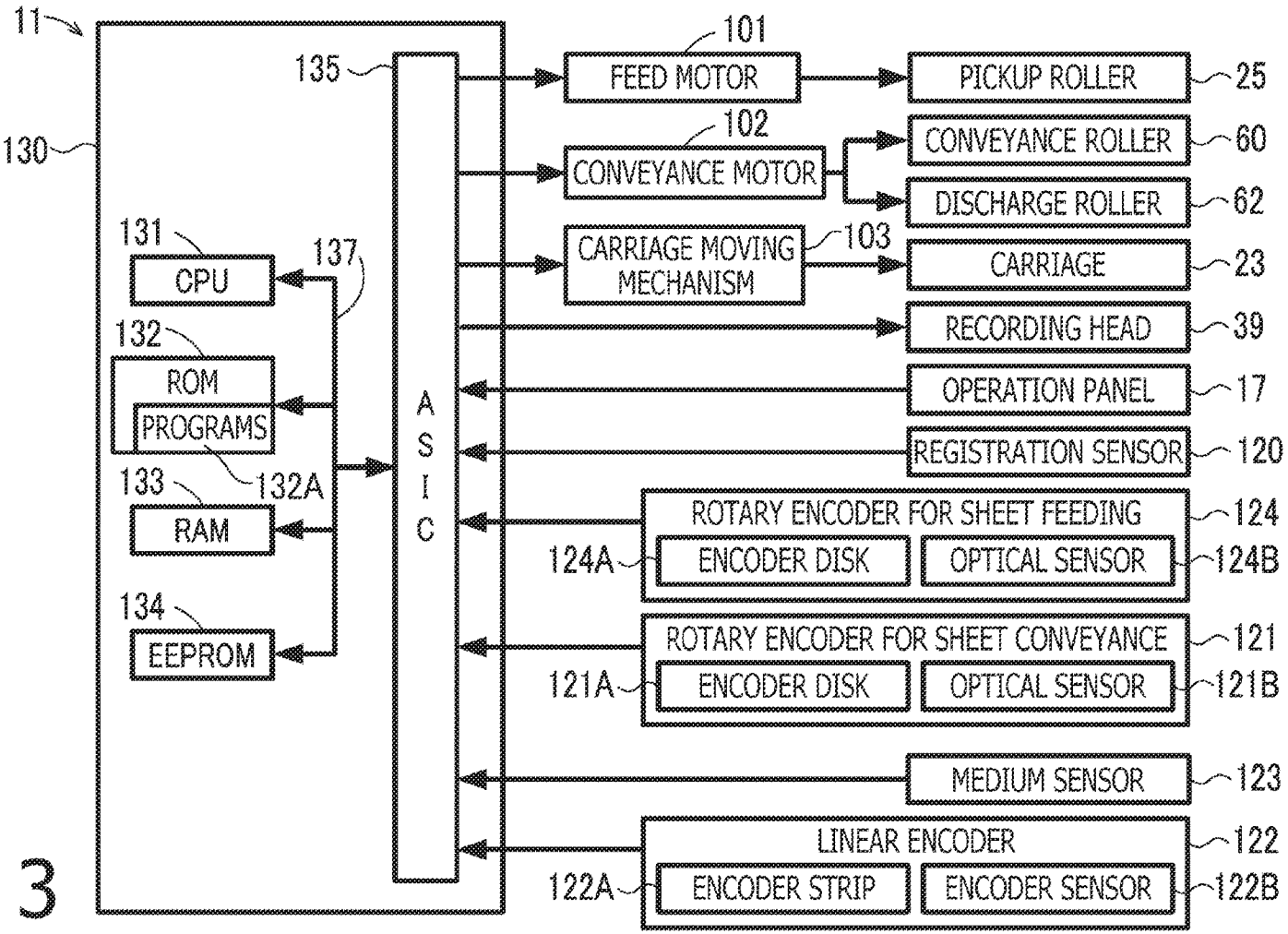
FIG. 3 is a block diagram schematically showing an electrical configuration of the printer in the illustrative embodiment according to one or more aspects of the present disclosure.

As shown in FIG. 3, the printer 11 includes a rotary encoder 124 for sheet feeding. The rotary encoder 124 for sheet feeding is configured to generate pulse signals in response to the pickup roller 25 being driven to rotate by the feed motor 101. The rotary encoder 124 for sheet feeding includes an encoder disk 124A and an optical sensor 124B. The encoder disk 124A rotates together with the rotation of the feed motor 101. The optical sensor 124B is configured to, while reading the encoder disk 124A rotating, generate pulse signals and transmit the generated pulse signals to the controller 130.

[Rotary Encoder for Sheet Conveyor]

As shown in FIG. 3, the printer 11 includes a rotary encoder 121 for sheet conveyance. The rotary encoder 121 for sheet conveyance is configured to generate pulse signals in response to the conveyance roller 60 being driven to rotate by the conveyance motor 102. The rotary encoder 121 for sheet conveyance includes an encoder disk 121A and an optical sensor 121B. The encoder disk 121A rotates together with the rotation of the conveyance motor 101. The optical sensor 121B is configured to, while reading the encoder disk 121A rotating, generate pulse signals and transmit the generated pulse signals to the controller 130.

[Image Recorder]

As shown in FIG. 2, the image recorder 24 is disposed between the conveyance roller unit 54 and the discharge roller unit 55 in the conveyance direction 16. Further, the image recorder 24 is disposed to face the platen 42 in a vertical direction 7. The image recorder 24 includes a carriage 23, a recording head 39, an encoder sensor 122B, and a medium sensor 123. Although the following features are not shown in any drawings, the carriage 23 is connected with an ink tube and a flexible flat cable. The ink tube supplies ink stored in an ink cartridge to the recording head 39. The flexible flat cable electrically connects the recording head 39 with a control board on which the controller 130 is mounted.

The carriage 23 is configured to reciprocate along a scanning direction by a carriage moving mechanism 103 (see FIG. 3). It is noted that the scanning direction is along a left-to-right direction 9. The carriage moving mechanism 103 includes a pair of guiderails (not shown), a known belt mechanism (not shown), and a carriage motor (not shown). The carriage 23 is supported by the guiderails. The guide rails extend in the left-to-right direction 9 in respective different positions spaced apart from each other in the front-to-rear direction 8. The carriage 23 is connected with the known belt mechanism disposed on the guiderails. The belt mechanism is driven by the carriage motor. Namely, the carriage 23, which is connected with the belt mechanism driven to revolve by the carriage motor, is configured to reciprocate along the scanning direction (i.e., along the left-to-right direction 9).

As shown in FIG. 2, the recording head 39 is mounted on the carriage 23. At a lower surface of the recording head 39, a plurality of nozzles 40 are formed. The recording head 39 is configured to discharge ink droplets from the nozzles 40. The printer 11 (more specifically, the controller 130) controls the recording head 39 to discharge ink droplets onto the recording sheet 12 supported by the platen 42 while moving the carriage 23. Thereby, an image is recorded on the recording sheet 12.

[Linear Encoder]

As shown in FIG. 3, the printer 11 includes a linear encoder 122. The linear encoder 122 includes an encoder strip 122A and an encoder sensor 122B. The encoder strip 122A is disposed on the guiderails. The encoder strip 122A is formed in a strip shape and extends in the left-to-right direction. The encoder sensor 122B is disposed in a position to face the encoder strip 122A. The encoder sensor 122B is mounted on a front section of the lower surface of the recording head 39. During the movement of the carriage 23, the encoder sensor 122B reads the encoder strip 122A and generates pulse signals, then transmits the generated pulse signals to the controller 130.

[Medium Sensor]

As shown in FIG. 3, the printer 11 includes the medium sensor 123. The medium sensor 123 is mounted on a rear section of the lower surface of the recording head 39 on the carriage 23. The medium sensor 123 includes a light emitting element and a light receiving element. The light emitting element includes a light emitting diode (hereinafter referred to as an "LED"). The light receiving element includes an optical sensor. Among light emitted by the light emitting element, a particular quantity of light is directed and incident onto the platen 42. The light incident on the platen 42 is reflected by the platen 42 or a recording sheet 12 on the platen 42, and the reflected light is received by the light receiving element. The medium sensor 123 transmits to the controller 130 a detection signal according to a quantity of the light received by the light receiving element. The controller 130 determines whether there exists a recording sheet 12 in a detectable position of the medium sensor 123 in the front-to-rear direction 8 or the left-to-right direction 9, based on a difference between the detection signal output from the medium sensor 123 detecting the reflected light from the platen 42 and the detection signal output from the medium sensor 123 detecting the reflected light from the recording sheet 12. Thereby, as will be described later, the controller 130 performs cueing conveyance to convey the recording sheet 12 to a recording start position and detects a sheet width of the recording sheet 12.

[Platen]

As shown in FIG. 2, the platen 42 is disposed between the conveyance roller unit 54 and the discharge roller unit 55 in the conveyance direction 16. The platen 42 is disposed to face the image recorder 24 in the vertical direction 7. The platen 42 supports from underneath the recording sheet 12 being conveyed by at least one of the conveyance roller unit 54 and the discharge roller unit 55.

[Controller]

As shown in FIG. 3, the controller 130 includes a CPU 131, a ROM 132, a RAM, an EEPROM 134, and an ASIC 135, which are interconnected via an internal bus 137. The ROM 132 stores programs 132A that, when executed by the CPU 131, cause the CPU 131 to control various operations. The RAM 133 serves as a storage area for temporarily storing data and signals to be used by the CPU 131 executing the programs, or serves as a work area for data processing by the CPU 131. The EEPROM 134 stores setting information to be preserved even after the printer 11 is turned off.

Specifically, the RAM 133 stores a leading-end detection flag, a feeding determination flag, a waiting time measurement flag, a remaining pass flag, and a feeding start flag.

An initial value of the leading-end detection flag is "0." In response to the registration sensor 120 being detected to be in the ON state, the leading-end detection flag is set to "1." In response to the registration sensor 120 being detected not to be in the ON state, the leading-end detection flag is set to "0." When the registration sensor 120 has been brought into the ON state in a state where the leading-end detection flag is "0," it represents that a leading end of a recording sheet 12 in the conveyance direction 16 has been detected by the registration sensor 120.

An initial value of the feeding determination flag is "0." In response to a conveyance distance of the recording sheet 12 from the nip position 57 (i.e., a distance over which the recording sheet 12 has been conveyed from the nip position 57) being determined to be equal to or more than 143 mm, the feeding determination flag is set to "1." In response to a below-mentioned feed timing determination process being performed when the feeding determination flag is "1," the feeding determination flag is set to "0."

An initial value of the remaining pass flag is "0." When it is determined that the conveyance distance of the recording sheet 12 from the nip position 57 is equal to or more than 143 mm and that the number of remaining passes is equal to 2 in a state where the remaining pass flag is 0, the remaining pass flag is set to "1." The "pass" will be described later. In response to the conveyance distance of the recording sheet 12 from the nip position 57 being determined not to be equal to or more than 143 mm, the remaining pass flag is set to "0."

An initial value of the feeding start flag is "0." The feeding start flag is set to "1" in response to the printer 11 is ready to start feeding a subsequent recording sheet 12. For instance, when the number of remaining passes is determined to be equal to or less than 1 (see FIG. 10, S75: No), in response to the preceding recording sheet 12 being discharged until the trailing end thereof is conveyed to a particular position downstream of the recording head 39 in the conveyance direction 16 (S79), the feeding start flag is set to "1." At this time, in response to determining that there is an image to be recorded on a next page, based on the image data stored in the RAM 133, the controller 130 starts feeding a subsequent recording sheet 12.

Further, the EEPROM 134 stores therein a particular waiting period of time for determining a timing to start sheet feeding of a subsequent recording sheet 12. For instance, the EEPROM 134 stores 10 msec as a particular waiting period of time for monochrome image recording on an A4-size recording sheet 12. In addition, the EEPROM 134 stores 273 msec as a particular waiting period of time for color image recording on an A4-size recording sheet 12. The waiting period of time will be described later.

Further, the EEPROM 134 stores therein 2 ips ("ips" is an abbreviated form of inch per second) as the first feeding speed and 6 ips as the second feeding speed. In addition, the EEPROM 134 stores 1 ips ("ips" is an abbreviated form of inch per second) as a third feeding speed. The first feeding speed, the second feeding speed, and the third feeding speed will be described later.

Further, the EEPROM 134 stores therein a particular speed-up period of time. When the printer 11 performs image recording for a final pass on a preceding recording sheet 12 while moving the carriage 23 all over a movable range of the carriage 23 in a single direction along the scanning direction, the particular speed-up period of time is a period of time from a time when the subsequent recording sheet 12 (i.e., the recording sheet 12 being fed) begins to be fed until a time when sheet conveyance ahead of image recording for the final pass on the preceding recording sheet 12 is completed.

The ASIC 135 is connected with the feed motor 101 and the conveyance motor 102. The ASIC 135 generates a drive signal for rotating each of the feed motor 101 and the conveyance motor 102, and controls each of the feed motor 101 and the conveyance motor 102 based on the generated drive signal. Each of the feed motor 101 and the conveyance motor 102 rotates forward or backward in accordance with the drive signal from the ASIC 135. Further, a rotational speed of each of the feed motor 101 and the conveyance motor 102 is changed based on the drive signal from the ASIC 135. Moreover, the controller 130 controls the recording head 39 to discharge ink droplets from the nozzles 40.

Further, the ASIC 135 is connected with an operation panel 17. The operation panel 17 is configured to transmit to the controller 130 an operation signal corresponding to a user operation to the operation panel 17. For instance, the operation panel 17 may include operable buttons and/or a touch sensor superposed on a display. The controller 130 controls each of the feed motor 101, the conveyance motor 102, and the recording head 39, based on the operation signal output from the operation panel 17.

Further, the ASIC 135 is connected with the registration sensor 120, the rotary encoder 124 for sheet feeding, the rotary encoder 121 for sheet conveyance, and the medium sensor 123. The controller 130 detects a position of a leading end of the recording sheet 12 in the conveyance direction, based on the detection signal output from the registration sensor 120 and the pulse signals output from the rotary encoder 121 for sheet conveyance. Hereinafter, the leading end of the recording sheet 12 in the conveyance direction may be simply referred to as "the leading end of the recording sheet 12." Further, the controller 130 detects that the leading end of the recording sheet 12 is fed to the nip position 57, based on the pulse signals output from the rotary encoder 124 for sheet feeding. Further, the controller 130 detects a length (i.e., the sheet width) of the recording sheet 12 in the left-to-right direction 9, based on the detection signal output from the medium sensor 123.

[Image Recording Process]

Figure 4A:
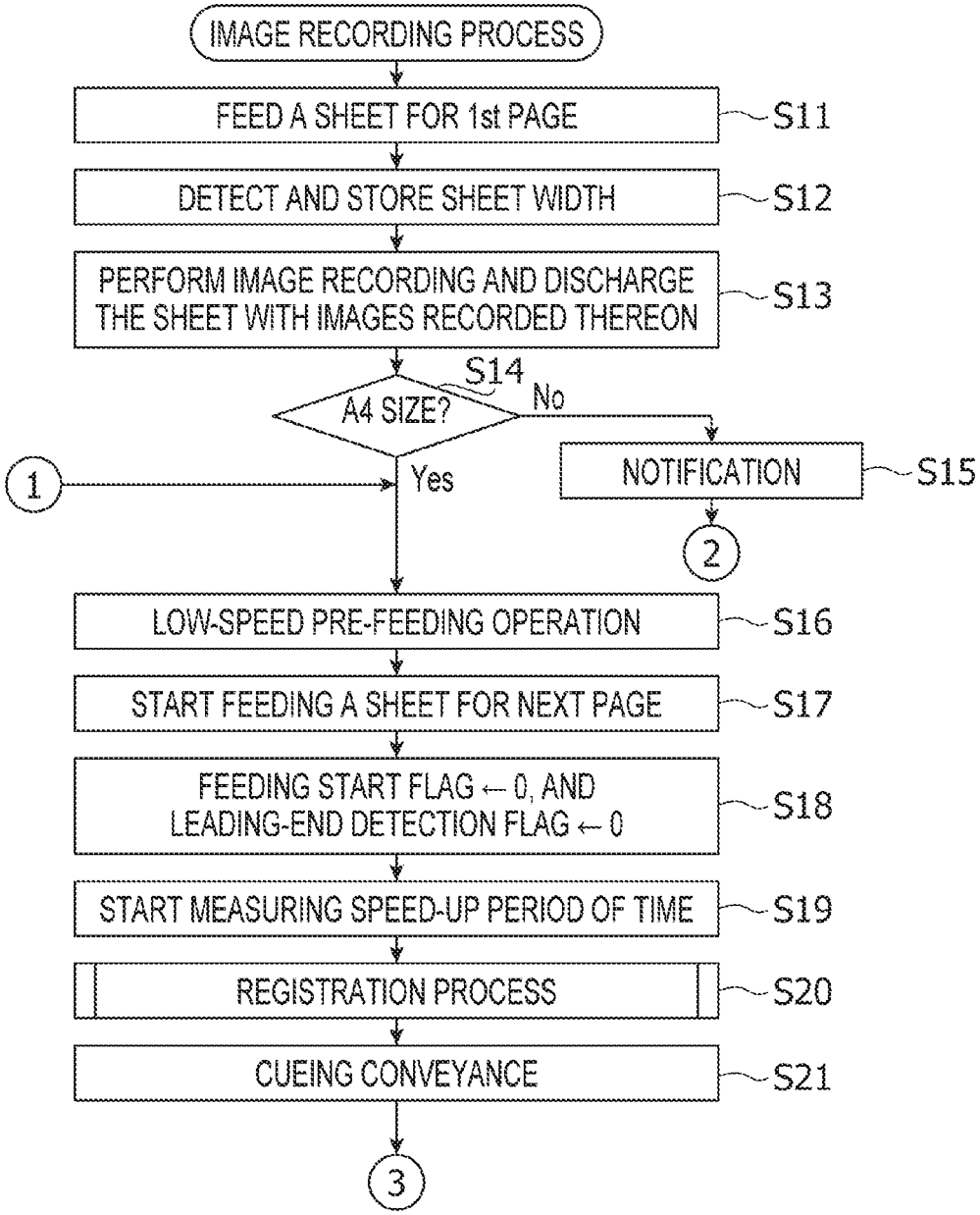
FIGS. 4A and 4B are flowcharts showing a procedure of an image recording process to be executed by a controller of the printer in the illustrative embodiment according to one or more aspects of the present disclosure.
Figure 4B:
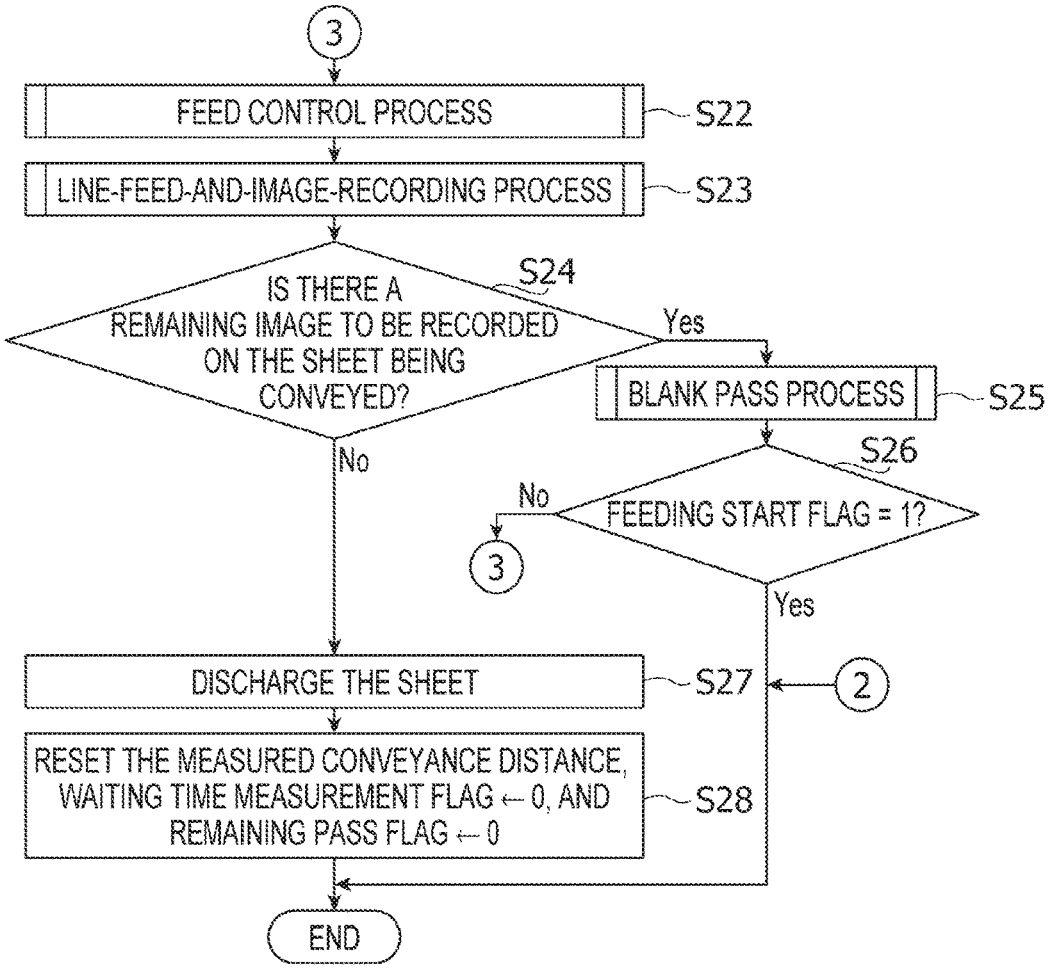

For instance, an image recording process shown in FIGS. 4A and 4B is started in response to the controller 130 receiving image data and a record instruction via a communication interface (not shown) from a PC ("PC" is an abbreviated form of Personal Computer) communicably connected with the MFP 10 via a network (not shown). The received image data is stored into the RAM 133. As will be described later, the image recording process is performed by the controller 130. More specifically, for instance, the image recording process may be performed by the CPU 131 executing one or more programs 132A stored in the ROM 132.

The following description will be provided under an assumption that character information is recorded as images on a recording sheet 12 of A4 size according to Japanese Industrial Standards. In this case, when performing bidirectional image recording (e.g., monochrome image recording) while reciprocating the carriage 23, the printer 11 records images in different areas on the recording sheet 12 in the conveyance direction 16 depending on whether the carriage 23 moves in a direction (e.g., a rightward direction) or the other direction (e.g., a leftward direction) along the scanning direction (i.e., the left-to-right direction). In this situation, movement of the carriage 23 in a single direction while image recording is performed by the recording head 39 may be referred to as a "pass." In the illustrative embodiment, when image recording is performed on an A4-size recording sheet 12 set with a longitudinal direction thereof along the conveyance direction 16, the printer 11 is allowed to cover a maximum recording area on the recording sheet 12 by performing image recording for 5 passes.

After completion of image recording for each single pass, the recording sheet 12 is conveyed in the conveyance direction 16 over a distance as long as a nozzle length of the nozzle 40 in the conveyance direction 16 (i.e., the front-to-rear direction 8). In other words, in the monochrome image recording, while the carriage 23 is moving in a single direction along the scanning direction (i.e., during the image recording for each single pass), the printer 11 halts the conveyance of the recording sheet 12 by stopping the conveyance motor 102. Meanwhile, between image recording for a preceding pass and image recording for a subsequent pass, the printer 11 conveys the recording sheet 12 in the conveyance direction 16 by rotating the conveyance motor 102 forward. The conveyance of the recording sheet 12 between image recording for the preceding pass and image recording for the subsequent pass may be referred to as "scanning line feed." Further, intermittently conveying the recording sheet 12 by alternately repeating conveyance and stop of the recording sheet 12 may be referred to as "intermittent conveyance."

Further, in unidirectional image recording (e.g., color image recording), the printer 11 performs image recording only when moving the carriage 23 in a particular single direction (e.g., the rightward direction) in each single cycle of reciprocation of the carriage 23 along the scanning direction. Meanwhile, the printer 11 does not perform image recording when moving the carriage 23 in the other direction (e.g., the leftward direction). In the color image reading, after each single cycle of reciprocation of the carriage 23, the recording sheet 12 is conveyed in the conveyance direction 16 over the distance as long as the nozzle length of the nozzle 40 in the conveyance direction 16 (i.e., the front-to-rear direction 8).

In the image recording process, first, the controller 130 transmits a control signal to a drive circuit (not shown) of the feed motor 101, thereby controlling the feed feeder 15 to feed a recording sheet 12 for a first page from the feed tray 20 (S11). Thus, the feed motor 101 begins to rotate forward, and the recording sheet 12 begins to be conveyed from the feed tray 20 to the conveyance path 65. Then, the controller 130 performs a registration process to put a leading end of the recording sheet 12 in the nip position 57 and perform skew correction for the recording sheet 12. The registration process (see FIG. 5) will be described later. At this time, the carriage 23 is positioned on a left side of a home position of the carriage 23. The home position is located at a right end of a movable range of the carriage 23 in the scanning direction.

Subsequently, the controller 130 transmits a control signal to a drive circuit (not shown) of the conveyance motor 102, thereby controlling the conveyance motor 102 to drive the conveyance roller 60 to convey the recording sheet 12 until a leading end of an image recording area of the recording sheet 12 reaches a recording start position, based on the image data stored in the RAM 133, an output signal from the medium sensor 123, and an output signal from the rotary encoder 121 for sheet conveyance. It is noted that the recording start position is a position corresponding to an upstream end of the nozzles 40 in the conveyance direction 16. Thus, the conveyance motor 102 begins to rotate forward, and thereby the recording sheet 12 begins to be conveyed. Substantially at a point of time when the leading end of the image recording area of the recording sheet 12 has reached the recording start position, the controller 130 halts the forward rotation of the conveyance motor 102 and the conveyance of the recording sheet 12. Hereinafter, conveying the recording sheet 12 until the leading end of the image recording area of the recording sheet 12 reaches the recording start position may be referred to as "cueing conveyance."

Next, the controller 130 transmits a control signal to a drive circuit (not shown) of each of the linear encoder 122, the medium sensor 123, and the carriage moving mechanism 103, thereby reciprocating the carriage 23 along the scanning direction in a state where the linear encoder 122 and the medium sensor 123 are activated. The controller 130 detects a left end and a right end of the recording sheet 12 based on output signals from the medium sensor 123. Further, the controller 130 detects respective positions where the left end and the right end of the recording sheet 12 have been detected in the left-to-right direction 9, based on output signals from the linear encoder 122. By identifying the respective positions of the left end and the right end of the recording sheet 12 based on the above detection results, the controller 130 detects the sheet width of the recording sheet 12 and stores the detected sheet width into the RAM 133 (S12).

Subsequently, based on the image data stored in the RAM 133, the controller 130 transmits a control signal to the drive circuit (not shown) of each of the carriage moving mechanism 103, the recording head 39, and the conveyance motor 102, thereby recording images on the recording sheet 12 for the first page and discharging the recording sheet 12 with the images recorded thereon onto the discharge tray 21 (S13). Thus, the recording sheet 12 is conveyed in the conveyance direction 16 in response to the conveyance motor 102 rotating forward. Further, the image recorder 24 reciprocates the carriage 23 along the scanning direction while causing the recording head 39 to discharge ink droplets onto the recording sheet 12. Consequently, images are recorded on the recording sheet 12 for the first page. Then, the recording sheet 12 with the images recorded thereon is discharged onto the discharge tray 21.

Next, the controller 130 determines whether the detected sheet width stored in the RAM 133 is identical to a sheet width of a recording sheet 12 of a particular size (e.g., A4 size according to Japanese Industrial Standards) that is stored in the EEPROM 134 as a size of the recording sheets 12 placed on the feed tray 20 (S14). For instance, the size of the recording sheets 12 placed on the feed tray 20 may be specified based on positions of side guides (not shown) for positioning the recording sheets 12 placed on the feed tray 20. In this case, the positions of the side guides may be detected by specific sensors (not shown) and stored into the RAM 133. Alternatively, the size of the recording sheets 12 placed on the feed tray 20 may be input by a user via the operation panel 17 and stored into the RAM 133.

In response to determining that the sheet width stored in the RAM 133 is not identical to the sheet width of A4 size (S14: No), the controller 130 transmits a control signal to the operation panel 17, thereby controlling the operation panel 17 to display a notification indicating that the size of the fed recording sheet 12 is not A4 size (S15). Then, the controller 130 terminates the image recording process.

Meanwhile, in response to determining that the sheet width stored in the RAM 133 is identical to the sheet width of A4 size (S14: Yes), the controller 130 transmits a control signal to the drive circuit of the feed motor 101, thereby controlling the sheet feeder 15 to perform a low-speed pre-feeding operation to rotate the feed motor 101 by a particular rotation amount (S16). The particular rotation amount is a rotation amount for releasing a backlash of one or more gears for transmitting a driving force from the feed motor 101 to the pickup roller 25. The particular rotation amount is previously stored in the EEPROM 134. At this time, in the low-speed pre-feeding operation, a recording sheet 12 for a next page may be fed by the pickup roller 25, e.g., at a third feeding speed of 1 ips. Nonetheless, the controller 130 may drive the sheet feeder 15 to only release the backlash of the one or more gears, without necessarily feeding the recording sheet 12. In this case, the sheet feeder 15 may be driven at a lower drive speed than when feeding the recording sheet 12 at the first feeding speed.

Next, the controller 130 transmits a control signal to the drive circuit of the feed motor 101, thereby controlling the sheet feeder 15 (the pickup roller 25) to start feeding the recording sheet 12 for the next page from the feed tray 20 at the first feeding speed stored in the EEPROM 134 (S17). The first feeding speed is a feeding speed for certainly separating a top recording sheet 12 from the other recording sheets 12 stacked on the feed tray 20. For instance, the first feeding speed may be 2 ips.

Then, the controller 130 sets to "0" each of the feeding start flag and the leading-end detection flag stored in the RAM 133 (S18). Recording sheets 12 for a third page and the following pages begin to be fed in response to the feeding start flag being set to "1." In response to the sheet feeding being started, the feeding start flag is set to "0."

Further, the controller 130 begins to measure a speed-up period of time (S19). When the measured speed-up period of time becomes equal to the particular speed-up period of time stored in the EEPROM 134, the feeding speed for the recording sheet 12 being fed is increased. In other words, the particular speed-up period of time is a period of time from a point of time when the sheet feeding is started to a point of time when the feeding speed is to be increased.

Subsequently, the controller 130 performs the registration process (S20). The registration process is a process to put the leading end of the recording sheet 12 in the nip position 57 of the conveyance roller unit 54. Hereinafter, putting the leading end of the recording sheet 12 in the nip position 57 may be referred to as "registration." The registration process will be described in more detail later.

Next, the controller 130 transmits a control signal to the drive circuit of the conveyance motor 102, thereby controlling the conveyance roller 60 to perform cueing conveyance of the recording sheet 12 registered in the nip position 57 (S21). Control for the cueing conveyance is the same as that for the cueing conveyance of the recording sheet 12 for the first page.

Subsequently, the controller 130 performs a feed control process (S22). The feed control process is a process to increase the feeding speed and halt sheet feeding. The feed control process will be described in more detail later.

Then, the controller 130 performs a line-feed-and-image-recording process (S23). The line-feed-and-image-recording process is a process to perform intermittent conveyance of the recording sheet 12 and perform image recording for a single pass. The line-feed-and-image-recording process will be described in more detail later.

Based on the image data stored in the RAM 133, the controller 130 determines whether there is a remaining image to be recorded on the recording sheet 12 being conveyed (S24).

In response to determining that there is a remaining image to be recorded on the recording sheet 12 being conveyed (S24: Yes), the controller 130 performs a blank pass process (S25). The blank pass process is a process to, when there is a pass having no image to be recorded in image recording for a remaining image to be recorded on the recording sheet 12 being conveyed, record the remaining image and discharge the recording sheet 12 before feeding a subsequent sheet 12. The blank pass process will be described in more detail later.

Subsequently, the controller 130 determines whether the feeding start flag stored in the RAM 133 is set to "1" (S26).

In response to determining that the feeding start flag stored in the RAM 133 is set to "1" (S26: Yes), the controller 130 terminates the image recording process for the present recording sheet 12. Nonetheless, as will be described later, before that, the controller 130 may have begun another image recording process from S16 (see FIGS. 4A and 4B) for a subsequent recording sheet 12.

Meanwhile, in response to determining that the feeding start flag stored in the RAM 133 is not set to "1" (S26: No), the controller 130 goes to S22. In S22, the controller 130 performs the feed control process.

Further, in response to determining that there is not a remaining image to be recorded on the recording sheet 12 being conveyed (S24: No), the controller 130 transmits a control signal to the drive circuit of the conveyance motor 102, thereby controlling the discharge roller 62 to discharge the recording sheet 12 onto the discharge tray 21 (S27).

Then, the controller 130 resets a measured conveyance distance of the recording sheet 12, and sets to "0" each of the waiting time measurement flag and the remaining pass flag stored in the RAM 133 (S28). The measurement of the conveyance distance will be described later. Afterwards, the controller 130 terminates the image recording process for the present recording sheet 12. Nonetheless, as will be described later, before that, the controller 130 may have begun another image recording process from S16 (see FIGS. 4A and 4B) for a subsequent recording sheet 12.

[Registration Process]

Figure 5:
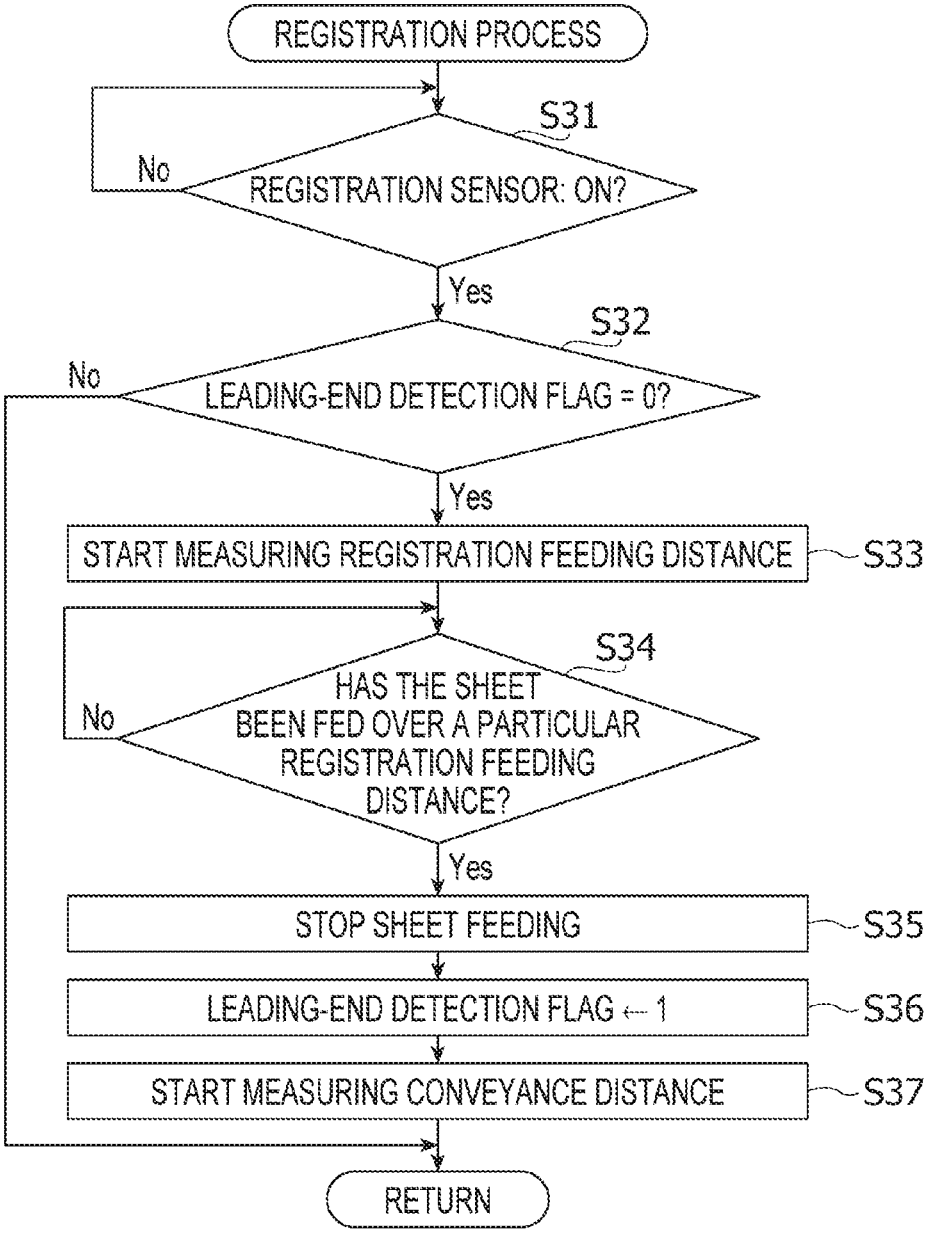
FIG. 5 is a flowchart showing a procedure of a registration process to be executed in the image recording process, in the illustrative embodiment according to one or more aspects of the present disclosure.

FIG. 5 is a flowchart showing an exemplary procedure of the registration process to be executed in S20 of the image recording process shown in FIGS. 4A and 4B.

In the registration process, first, the controller 130 determines whether the registration sensor 120 is in the ON state (i.e., whether the registration sensor 120 outputs a high-level signal), based on an output signal from the registration sensor 120 (S31).

In response to determining that the registration sensor 120 is in the ON state (S31: Yes), the controller 130 determines whether the leading-end detection flag stored in the RAM 133 is "0" (S32).

In response to determining that the leading-end detection flag stored in the RAM 133 is "0" (S32: Yes), the controller 130 begins to measure a registration feeding distance (S33). The registration feeding distance is measured based on the number of pulse signals output from the rotary encoder 124 for sheet feeding. When the registration sensor 120 is in the ON state, and the leading-end detection flag is "0," it represents that the leading end of the recording sheet 12 has been detected.

Then, based on output signals from the rotary encoder 124 for sheet feeding, the controller 130 determines whether the recording sheet 12 has been fed over a particular registration feeding distance after beginning to measure the registration feeding distance (S34). The particular registration feeding distance is a distance over which the recording sheet 12 is fed from a time when the leading end of the recording sheet 12 reaches the registration sensor 120 until a time when the leading end thereof reaches the nip position 57. The particular registration feeding distance is previously stored in the EEPROM 134. The controller 130 continues to make the determination in S34 until determining that the recording sheet 12 has been fed over the particular registration feeding distance after beginning to measure the registration feeding distance (S34: No). When determining that the recording sheet 12 has been fed over the particular registration feeding distance after beginning to measure the registration feeding distance (S34: Yes), the controller 130 determines that the recording sheet 12 has been registered. Feed timing to start feeding the recording sheet 12 and the feeding speed for the recording sheet 12 are selected such that the recording sheet 12 is registered during a period in which the conveyance motor 102 is stopped (i.e., during a period in which image reading is being performed on a preceding recording sheet 12). Skew of the recording sheet 12 is corrected as the leading end thereof is brought into contact with the nip position 57 between the conveyance roller 60 and the pinch roller 61.

In response to determining that the recording sheet 12 has been fed over the particular registration feeding distance after beginning to measure the registration feeding distance (S34: Yes), the controller 130 transmits a control signal to the drive circuit of the feed motor 101, thereby controlling the sheet feeder 15 to stop feeding the recording sheet 12 (S35).

Then, the controller 130 sets the leading-end detection flag stored in the RAM 133 to "1" (S36).

Subsequently, the controller 130 begins to measure a conveyance distance (S37). Then, the controller 130 terminates the registration process and returns to the flow shown in FIGS. 4A and 4B. The conveyance distance is a distance over which the recording sheet 12 is conveyed after the registration thereof. The conveyance distance is measured based on the number of pulse signals output from the rotary encoder 121 for sheet conveyance.

Meanwhile, in response to determining that the registration sensor 120 is not in the ON state (S31: No), the controller 130 goes back to S31. Namely, the controller 130 continues to feed the recording sheet 12 until the leading end thereof is detected by the registration sensor 120 (S31: No).

Further, in response to determining that the leading-end detection flag stored in the RAM 133 is not "0" (S32: No), the controller 130 terminates the registration process.

[Feed Control Process]

Figure 6:
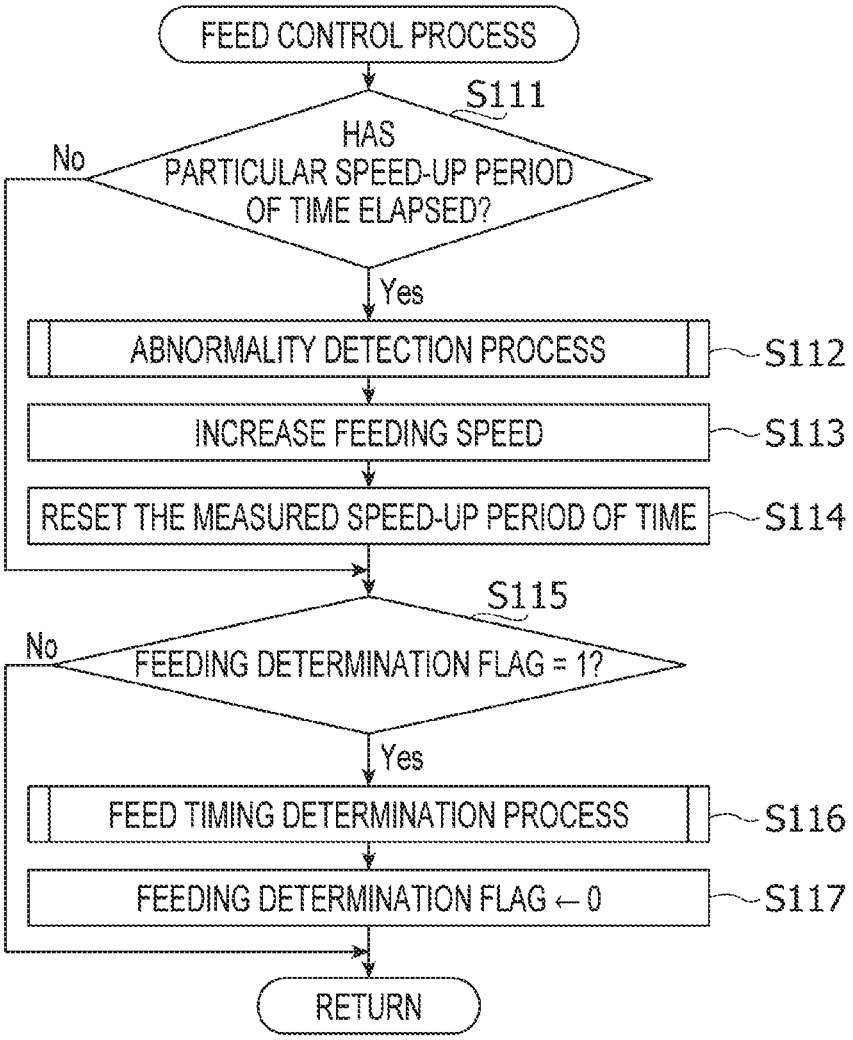
FIG. 6 is a flowchart showing a procedure of a feed control process to be executed in the image recording process, in the illustrative embodiment according to one or more aspects of the present disclosure.

FIG. 6 is a flowchart showing an exemplary procedure of the feed control process to be executed in S22 of the image recording process shown in FIGS. 4A and 4B.

In the feed control process, first, the controller 130 determines whether the particular speed-up period of time stored in the EEPROM 134 has elapsed (S111). In the case where the printer 11 performs image recording for a final pass on a preceding recording sheet 12 while moving the carriage 23 all over the movable range of the carriage 23 in the scanning direction, the particular speed-up period of time is a period of time required from a time when the subsequent recording sheet 12 begins to be fed until a time when sheet conveyance ahead of the image recording for the final pass is completed in the intermittent conveyance of the preceding recording sheet 12.

In response to determining that the particular speed-up period of time stored in the EEPROM 134 has elapsed (S111: Yes), the controller 130 performs an abnormality detection process (S112). The abnormality detection process is a process to determine whether there is an abnormality caused in conveyance of the recording sheet 12. The abnormality detection process will be described in more detail later.

Next, the controller 130 transmits a control signal to the drive circuit of the feed motor 101, thereby changing the feeding speed for the recording sheet 12 to the second feeding speed stored in the EEPROM 134 and feeding the recording sheet 12 at the second feeding speed (S113). Specifically, the controller 130 changes a rotational speed of the feed motor 101, thereby changing a rotational speed of the pickup roller 25 and changing the feeding speed for the recording sheet 12 to the second feeding speed. The second feeding speed is higher than the first feeding speed. For instance, the second feeding speed is 6 ips.

Next, the controller 130 resets the measured speed-up period of time (S114).

Next, the controller 130 determines whether the feeding determination flag stored in the RAM 133 is set to "1" (S115).

Further, in response to determining that the particular speed-up period of time stored in the EEPROM 134 has not elapsed (S111: No), the controller 130 determines whether the feeding determination flag stored in the RAM 133 is set to "1" (S115).

In response to determining that the feeding determination flag stored in the RAM 133 is set to "1" (S115: Yes), the controller 130 performs a feed timing determination process (S116). The feed timing determination process is a process to set the feeding start flag to "1" when the particular waiting period of time previously stored in the EEPROM 134 has elapsed since a waiting period of time began to be measured. The feed timing determination process will be described in more detail later.

Subsequently, the controller 130 sets the feeding determination flag stored in the RAM 133 to "0" (S117). Afterwards, the controller 130 terminates the feed control process and returns to the flow of FIGS. 4A and 4B.

[Line-Feed-and-Image-Recording Process]

Figure 7:
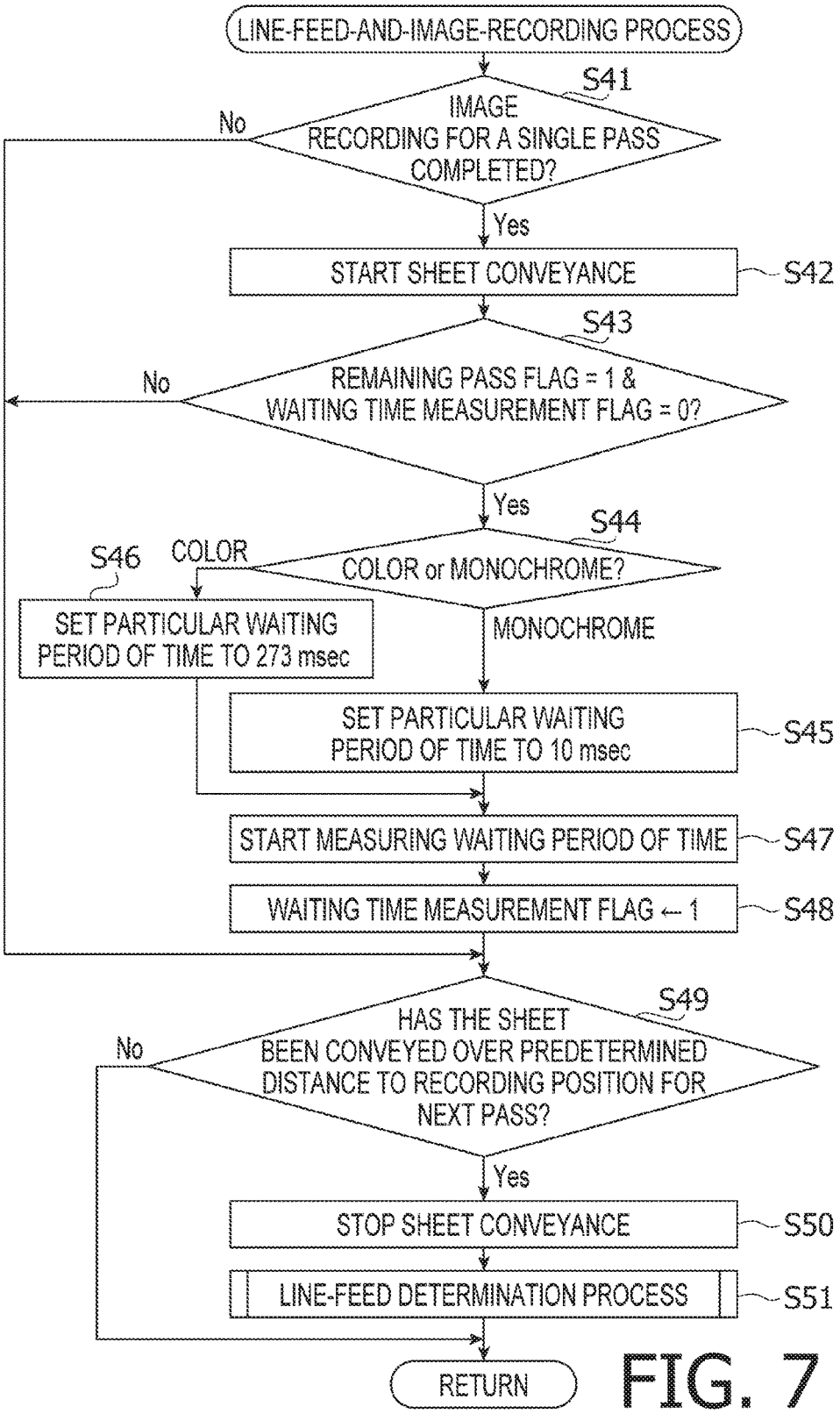
FIG. 7 is a flowchart showing a procedure of a line-feed-and-image-recording process to be executed in the image recording process, in the illustrative embodiment according to one or more aspects of the present disclosure.

FIG. 7 is a flowchart showing an exemplary procedure of the line-feed-and-image-recording process to be executed in S23 of the image recording process shown in FIGS. 4A and 4B.

In the line-feed-and-image-recording process, first, the controller 130 determines whether image recording for a single pass on the recording sheet 12 has been completed (S41). It is noted that the determination that image recording for a single pass on the recording sheet 12 has been completed is made in the first-executed S41 after image recording for the single pass on the recording sheet 12 has actually been completed. For instance, the controller 130 may make the determination in S41 that image recording for a single pass on the recording sheet 12 has been completed, in response to receiving from the drive circuit of the recording head 39 an output signal representing completion of image recording for the single pass.

In response to determining that image recording for a single pass on the recording sheet 12 has been completed (S41: Yes), the controller 130 transmits a control signal to the drive circuit of the conveyance motor 102, thereby controlling the conveyance roller 60 to start conveying the recording sheet 12 towards a recording position for a next pass (S42).

Subsequently, the controller 130 determines whether the remaining pass flag stored in the RAM 133 is "1" and whether the waiting time measurement flag stored in the RAM 133 is "0" (S43). When the remaining pass flag stored in the RAM 133 is "1," and the waiting time measurement flag stored in the RAM 133 is "0," it represents that next conveyance of the recording sheet 12 in the intermittent conveyance has been started after the trailing end of the recording sheet 12 was determined to be fed out of the feed tray 20.

In response to determining that the remaining pass flag stored in the RAM 133 is "1" and that the waiting time measurement flag stored in the RAM 133 is "0" (S43: Yes), the controller 130 determines whether image recording for remaining passes in the record instruction received from the PC or the image data stored in the RAM 133 is color image recording or monochrome image recording (S44). The controller 130 may make the determination in S44, based on the record instruction (including recording condition) previously stored in the RAM 133.

In response to determining that image recording for the remaining passes is monochrome image recording (S44: Monochrome), the controller 130 stores 10 msec into the RAM 133 as the particular waiting period of time (S45). Meanwhile, in response to determining that image recording for the remaining passes is color image recording (S44: Color), the controller 130 stores 273 msec into the RAM 133 as the particular waiting period of time (S46). In the color image recording, the printer 11 performs image recording only when moving the carriage 23 in a particular single direction (e.g., the rightward direction) in each single cycle of reciprocation of the carriage 23 along the scanning direction. Meanwhile, the printer 11 does not perform image recording when moving the carriage 23 in the other direction (e.g., the leftward direction). Therefore, the color image recording needs a longer waiting period of time than the monochrome image recording.

The controller 130 stores the particular waiting period of time into the RAM 133, and thereafter starts measuring the waiting period of time (S47).

The particular waiting period of time is a period of time for determining a timing to start feeding a subsequent recording sheet 12 from the feed tray 20. The waiting period of time is a period of time to be measured in response to next conveyance of the preceding recording sheet 12 in the intermittent conveyance being started after the trailing end of the preceding recording sheet 12 is determined to be fed out of the feed tray 20. The particular waiting period of time is set to such a period of time as to, when each recording sheet 12 is fed at the first feeding speed and the second feeding speed stored in the EEPROM 134, prevent a subsequent recording sheet 12 from colliding with a preceding recording sheet 12, and to bring the leading end of the subsequent recording sheet 12 into contact with the nip position 57 during execution of image recording for the final pass on the preceding recording sheet 12.

Then, the controller 130 sets the waiting time measurement flag stored in the RAM 133 to "1" (S48).

Next, based on output signals from the rotary encoder 121 for sheet conveyance, the controller 130 determines whether the recording sheet 12 has been conveyed over a predetermined distance up to the recording position for the next pass (S49). The predetermined distance is stored in the RAM 133.

Additionally, in response to determining that image recording for a single pass on the recording sheet 12 has not been completed (S41: No), the controller 130 determines whether the recording sheet 12 has been conveyed over the predetermined distance to the recording position for the next pass, based on output signals from the rotary encoder 121 for sheet conveyance (S49). Further, in response to determining that the remaining pass flag stored in the RAM 133 is not "1" or that the waiting time measurement flag stored in the RAM 133 is not "0" (S43: No), the controller 130 determines whether the recording sheet 12 has been conveyed over the predetermined distance to the recording position for the next pass, based on output signals from the rotary encoder 121 for sheet conveyance (S49).

In response to determining that the recording sheet 12 has been conveyed over the predetermined distance to the recording position for the next pass (S49: Yes), the controller 130 transmits a control signal to the drive circuit of the conveyance motor 102, thereby controlling the conveyance roller 60 to stop conveying the recording sheet 12 (S50). With respect to a rotation amount of the conveyance motor 102 for conveying the recording sheet 12 over the predetermined distance, a predetermined number of pulses to be output from the rotary encoder 121 for sheet conveyance is previously stored in the EEPROM 134. Thereby, in response detecting to the predetermined number of pulses, the controller 130 determines that the recording sheet 12 has been conveyed over the predetermined distance to the recording position for the next pass (S49: Yes), and stops conveying the recording sheet 12.

Then, the controller 130 performs a line-feed determination process (S51). The line-feed determination process is a process to determine whether the conveyance distance of the recording sheet 12 from the nip position 57 has become equal to or more than 143 mm and whether the number of remaining passes is equal to 2 at a point of time when the conveyance distance of the recording sheet 12 from the nip position 57 has become equal to or more than 143 mm. When the conveyance distance of the recording sheet 12 from the nip position 57 is equal to or more than 143 mm, it represents that the trailing end of the A4-size recording sheet 12 has been fed out of the feed tray 20. The line-feed determination process will be described in more detail later. Afterwards, the controller 130 terminates the line-feed-and-image-recording process and returns to the flow of FIGS. 4A and 4B.

Meanwhile, in response to determining that the recording sheet 12 has not been conveyed over the predetermined distance to the recording position for the next pass (S49: No), the controller 130 terminates the line-feed-and-image-recording process without executing S50 or S51, and returns to the flow of FIGS. 4A and 4B.

[Abnormality Detection Process]

Figure 8:
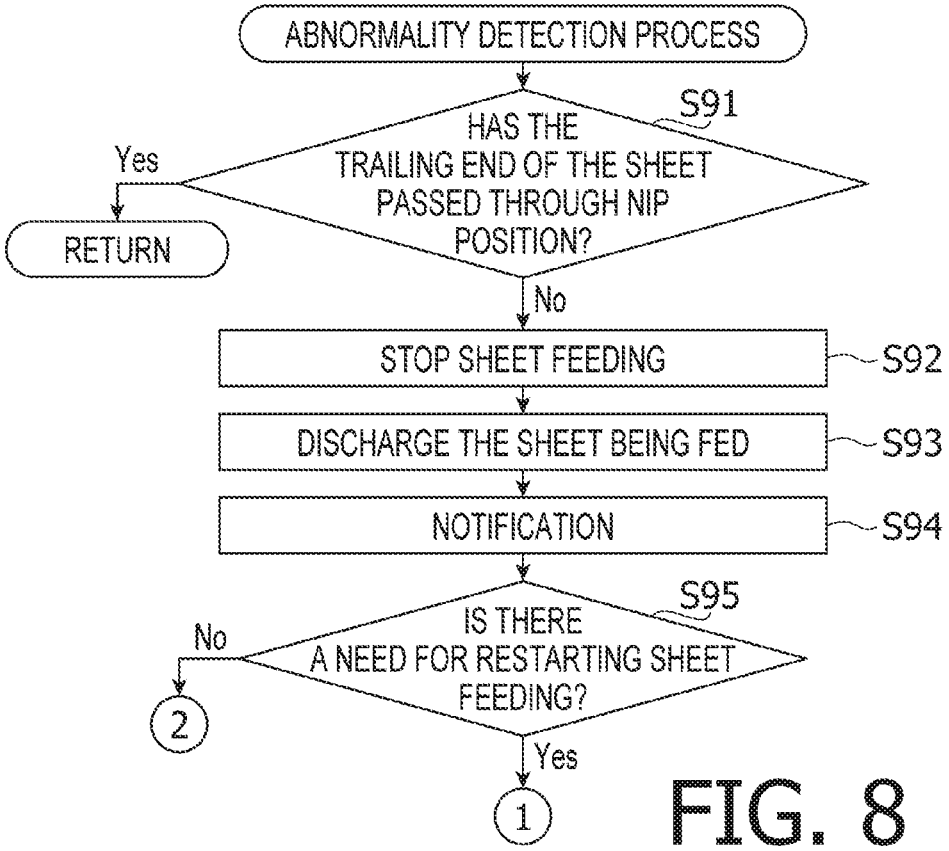
FIG. 8 is a flowchart showing a procedure of an abnormality detection process to be executed in the feed control process, in the illustrative embodiment according to one or more aspects of the present disclosure.

FIG. 8 is a flowchart showing an exemplary procedure of the abnormality detection process to be executed in S112 (see FIG. 6).

In the abnormality detection process, in S91, based on output signals from the rotary encoder 121 for sheet conveyance, the controller 130 determines whether a preceding recording sheet 12 has been conveyed over a particular conveyance distance since the conveyance distance of the preceding recording sheet 12 begun to be measured in S37 (see FIG. 5). The particular conveyance distance is a conveyance distance over which the A4-size recording sheet 12 is conveyed from a time when the leading end thereof reaches the nip position 57 until a time when the trailing end thereof passes through the nip position 57. Namely, in S91, the controller 130 determines whether the trailing end of the preceding recording sheet 12 has passed through the nip position 57.

In response to determining that the preceding recording sheet 12 has been conveyed over the particular conveyance distance (S91: Yes), the controller 130 terminates the abnormality detection process and returns to the flow of FIG. 6. Meanwhile, in response to determining that the preceding recording sheet 12 has not been conveyed over the particular conveyance distance (S91: No), the controller 130 goes to S92.

In S92, the controller 130 transmits a control signal to the drive circuit of the feed motor 101, thereby controlling the sheet feeder 15 to stop feeding of the recording sheet 12.

Then, the controller 130 transmits a control signal to the drive circuit of each of the feed motor 101 and the conveyance motor 102, thereby controlling the pickup roller 25 and the conveyance roller 60 to discharge the recording sheet 12 onto the discharge tray 21 (S93). Afterwards, the controller 130 transmits a control signal to the operation panel 17, thereby controlling the operation panel 17 to display a notification indicating that an abnormality has been detected during the sheet feeding and an inquiry as to whether to restart sheet feeding (S94). In response to accepting a user's input operation to restart sheet feeding via the operation panel 17 (S95: Yes), the controller 130 goes to S16 (see FIG. 4A) to restart sheet feeding. Meanwhile, in response to accepting a user's input operation to not restart sheet feeding via the operation panel 17 (S95: No), the controller 130 terminates the image recording process (see FIGS. 4A and 4B) without restarting sheet feeding.

[Feed Timing Determination Process]

Figure 9:
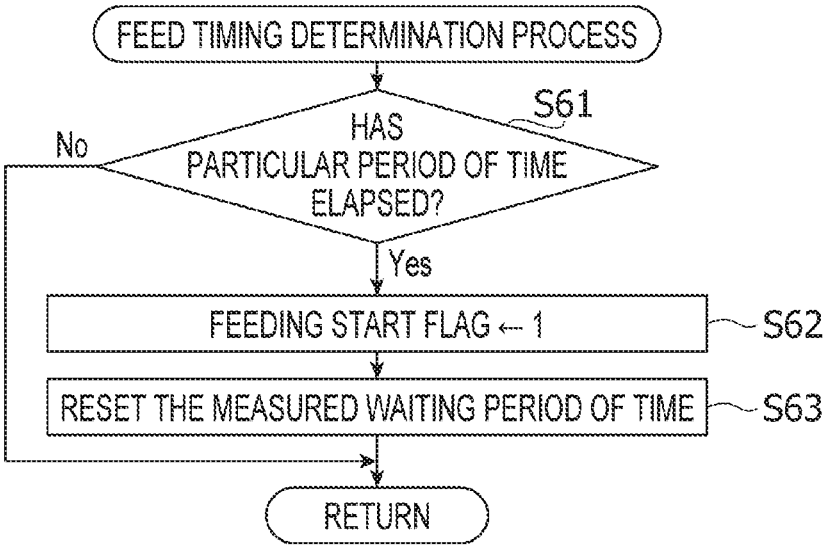
FIG. 9 is a flowchart showing a procedure of a feed timing determination process to be executed in the feed control process, in the illustrative embodiment according to one or more aspects of the present disclosure.

FIG. 9 is a flowchart showing an exemplary procedure of the feed timing determination process to be executed in S116 (see FIG. 6).

In the feed timing determination process, first, the controller 130 determines whether the particular waiting period of time stored in the RAM 133 has elapsed (S61).

In response to determining that the particular waiting period of time stored in the RAM 133 has elapsed (S61: Yes), the controller 130 sets the feeding start flag stored in the RAM 133 to "1" (S62). At this time, it is noted that, in response to determining that there is an image to be recorded on a next page, based on the image data stored in the RAM 133, the controller 130 begins another image recording process from S16 (see FIGS. 4A and 4B) for a subsequent recording sheet 12. In other words, substantially at a point of time when the particular waiting period of time has elapsed (S61: Yes), a subsequent recording sheet 12 begins to be fed from the feed tray 20 in S16 of another image recording process (see FIGS. 4A and 4B). After S62, the controller 130 resets the measured waiting period of time (S63). Afterwards, the controller 130 terminates the feed timing determination process and returns to the flow of FIG. 6.

Further, in response to determining that the particular waiting period of time stored in the RAM 133 has not elapsed (S61: No), the controller 130 terminates the feed timing determination process and returns to the flow of FIG. 6.

[Line-Feed Determination Process]

Figure 10:
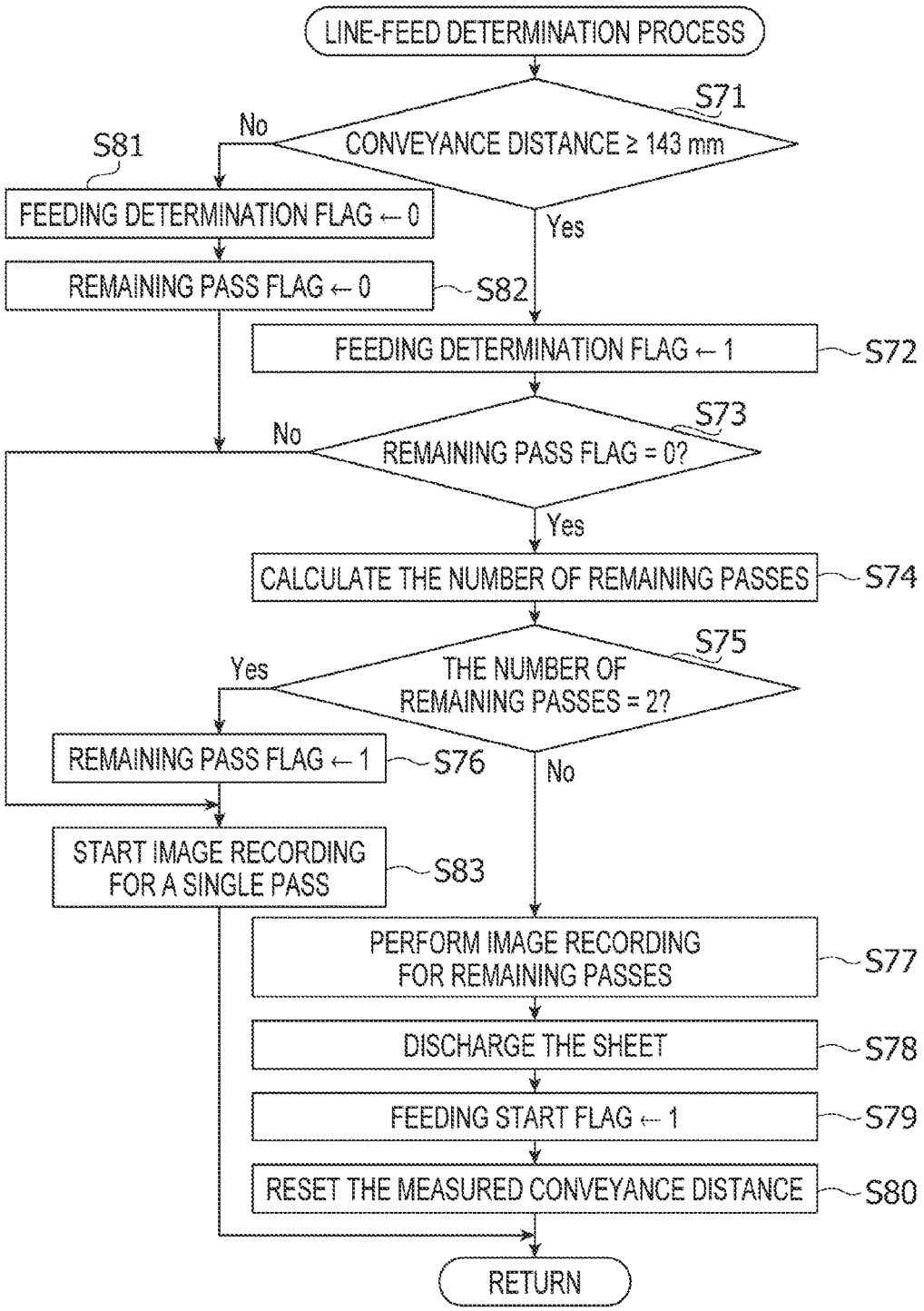
FIG. 10 is a flowchart showing a procedure of a line feed determination process to be executed in the line-feed-and-image-recording process, in the illustrative embodiment according to one or more aspects of the present disclosure.

FIG. 10 is a flowchart showing an exemplary procedure of the line-feed determination process to be executed in S51 (see FIG. 7).

In the line-feed determination process, first, the controller 130 determines whether the conveyance distance of the recording sheet 12 from the nip position 57 is equal to or more than 143 mm that is stored as a predetermined conveyance distance in the EEPROM 134, based on output signals from the rotary encoder 121 for sheet conveyance (S71). When the conveyance distance of the recording sheet 12 from the nip position 57 is equal to or more than 143 mm, it represents that the trailing end of the A4-size recording sheet 12 has been fed out of the feed tray 20.

In response to determining that the conveyance distance of the recording sheet 12 from the nip position 57 is equal to or more than 143 mm (S71: Yes), the controller 130 sets the feeding determination flag stored in the RAM 133 to "1" (S72).

Then, the controller 130 determines whether the remaining pass flag stored in the RAM 133 is "0" (S73).

In response to determining that the remaining pass flag stored in the RAM 133 is "0" (S73: Yes), the controller 130 calculates the number of remaining passes excluding a pass to be recorded from now, based on the image data stored in the RAM 133 (S74).

Then, the controller 130 determines whether the number of remaining passes is 2 (S75). The determination in S75 is made in the first-executed line-feed determination process after the conveyance distance of the recording sheet 12 from the nip position 57 has been equal to or more than 143 mm. At a point of time when the A4-size recording sheet 12 is conveyed over a conveyance distance of 143 mm from the nip position 57, the maximum number of remaining passes is 2. It is noted that the remaining passes do not include a first pass to be recorded from now in a present position of the recording sheet 12 on the conveyance path 65.

In response to determining that the number of remaining passes is 2 (S75: Yes), the controller 130 sets the remaining pass flag stored in the RAM 133 to "1" (S76). Afterwards, the controller 130 terminates the line-feed determination process and returns to the flow of FIG. 7.

Meanwhile, in response to determining that the remaining pass flag stored in the RAM 133 is not "0" (S73: No), the controller 130 outputs a control signal to the drive circuit of the recording head 39, thereby controlling the recording head 39 to start image recording for a single pass (i.e., the first pass to be recorded from now in the present position of the recording sheet 12 on the conveyance path 65) (S83). Afterwards, the controller 130 terminates the line-feed determination process and returns to the flow of FIG. 7.

Further, in response to determining that the number of remaining passes is equal to or less than 1 (S75: No), the controller 130 transmits a control signal to the drive circuit of each of the recording head 39 and the conveyance motor 102, thereby controlling the recording head 39 and the conveyance motor 102 to perform image recording for each remaining pass (including the first pass to be recorded from now in the present position of the recording sheet 12 on the conveyance path 65) (S77). Then, the controller 130 transmits a control signal to the drive circuit of the conveyance motor 102, thereby controlling the discharge roller 62 to discharge the recording sheet 12 with images recorded thereon towards the discharge tray 21 (S78). At this time, the controller 130 detects a conveyance distance of the recording sheet 12 by counting the number of pulse signals from the rotary encoder 121 for sheet conveyance. Then, in response to determining that the detected conveyance distance is a specific conveyance distance, the controller 130 sets the feeding start flag stored in the RAM 133 to "1" (S79). The specific conveyance distance is a conveyance distance over which the recording sheet 12 is conveyed from a time when the recording sheet 12 begins to be discharged until a time when the trailing end thereof is conveyed to the particular position downstream of the recording head 39 in the conveyance direction 16. In the illustrative embodiment, more specifically, the particular position may be 20 mm downstream of the discharge roller unit 55 in the conveyance direction 16. Further, at this time, in response to determining that there is an image to be recorded on a next page, based on the image data stored in the RAM 133, the controller 130 begins another image recording process from S16 (see FIGS. 4A and 4B) for a subsequent recording sheet 12. In other words, substantially at a point of time when the trailing end of the preceding recording sheet 12 has been discharged up to the particular position that is 20 mm downstream of the discharge roller unit 55 in the conveyance direction 16, a subsequent recording sheet 12 begins to be fed from the feed tray 20 in S16 of another image recording process (see FIGS. 4A and 4B).

Then, the controller 130 resets the measured conveyance distance (S80). Afterwards, the controller 130 terminates the line-feed determination process and returns to the flow of FIG. 7.

Further, in response to determining that the conveyance distance of the recording sheet 12 from the nip position 57 is not equal to or more than 143 mm (S71: No), the controller 130 sets the feeding determination flag stored in the RAM 133 to "0" (S81).

Further, the controller 130 sets the remaining pass flag stored in the RAM 133 to "0" (S82). Thereafter, the controller 130 outputs a control signal to the drive circuit of the recording head 39, thereby controlling the recording head 39 to start image recording for a single pass (i.e., the first pass to be recorded from now in the present position of the recording sheet 12 on the conveyance path 65) (S83). Afterwards, the controller 130 terminates the line-feed determination process and returns to the flow of FIG. 7.

[Blank Pass Process]

Figure 11:
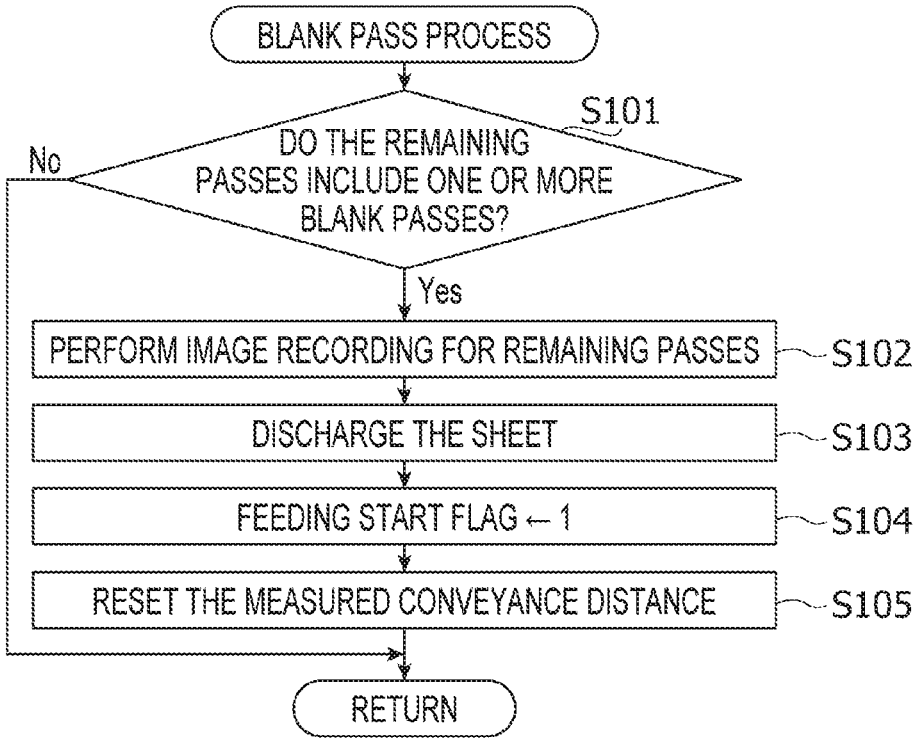
FIG. 11 is a flowchart showing a procedure of a blank pass process to be executed in the image recording process, in the illustrative embodiment according to one or more aspects of the present disclosure.

FIG. 11 is a flowchart showing an exemplary procedure of the blank pass process to be executed in S25 (see FIG. 4B).

In the blank pass process, first, the controller 130 determines whether the remaining passes include one or more blank passes, based on the image data stored in the RAM 133 (S101). The blank pass is a pass of which an entire image recording area is a blank area with no image to be recorded therein. More specifically, the blank pass is such a pass that a blank area thereof having no image to be recorded over a whole length of the recording sheet 12 in the scanning direction is longer than the nozzle length of the nozzle 40, in the conveyance direction 16.

In response to determining that the remaining passes do not include any blank passes (S101: No), the controller 130 terminates the blank pass process and returns to the flow of FIGS. 4A and 4B.

Meanwhile, in response to determining that the remaining passes include one or more blank passes (S101: Yes), the controller 130 transmits a control signal to the drive circuit of each of the recording head 39 and the conveyance motor 102, thereby controlling the recording head 39 and the conveyance motor 102 to perform image recording for each remaining pass on the recording sheet 12 (S102). Nonetheless, when the remaining passes include one or more blank passes, the controller 130 outputs a control signal to the drive circuit of the conveyance motor 102, thereby controlling the conveyance roller 60 to convey the recording sheet 12 over a distance as long as each blank pass in the conveyance direction 16 up to a recording position of a next pass to be recorded, without moving the carriage 23. Thus, the controller 130 skips image recording for each blank pass. Afterwards, the controller 130 transmits a control signal to the drive circuit of the conveyance motor 102, thereby controlling the discharge roller 62 to discharge the recording sheet 12 with images recorded thereon towards the discharge tray 21 (S103). At this time, the controller 130 detects a conveyance distance of the recording sheet 12 by counting the number of pulse signals from the rotary encoder 121 for sheet conveyance. Then, in response to determining that the detected conveyance distance is the aforementioned specific conveyance distance, the controller 130 sets the feeding start flag stored in the RAM 133 to "1" (S104). As described above, the specific conveyance distance is a conveyance distance over which the recording sheet 12 is conveyed from a time when the recording sheet 12 begins to be discharged until a time when the trailing end thereof is conveyed to the particular position downstream of the recording head 39 in the conveyance direction 16. In the illustrative embodiment, more specifically, the particular position may be 20 mm downstream of the discharge roller unit 55 in the conveyance direction 16. Further, at this time, in response to determining that there is an image to be recorded on a next page, based on the image data stored in the RAM 133, the controller 130 begins another image recording process from S16 (see FIGS. 4A and 4B) for a subsequent recording sheet 12. In other words, substantially at a point of time when the trailing end of the preceding recording sheet 12 has been discharged up to the particular position that is 20 mm downstream of the discharge roller unit 55 in the conveyance direction 16, a subsequent recording sheet 12 begins to be fed from the feed tray 20 in S16 of another image recording process (see FIGS. 4A and 4B).

Then, the controller 130 resets the measured conveyance distance (S105). Afterwards, the controller 130 terminates the blank pass process and returns to the flow of FIGS. 4A and 4B.

Operations and Advantageous Effects of Illustrative Embodiment

As described above, when the number of remaining passes in image recording on a preceding recording sheet 12 is 2, a subsequent recording sheet 12 begins to be fed substantially at a point of time when the particular waiting period of time (e.g., 10 msec) has elapsed from a next timing to start sheet conveyance in the intermittent conveyance of the preceding recording sheet 12. The subsequent recording sheet 12 begins to be fed at the first feeding speed (e.g., 2 ips), and thereafter is fed at the second feeding speed (e.g., 6 ips). Thereby, it is possible to feed the subsequent recording sheet 12 in such a manner as not to catch up with the preceding recording sheet 12 and to prevent an inappropriately widened gap between the two recording sheets 12. Consequently, it is possible to feed the subsequent recording sheet 12 to be separated an appropriate short distance away from the preceding recording sheet 12.

During the intermittent conveyance of the preceding recording sheet 12, the subsequent recording sheet 12 is fed to and registered in the nip position 57. Therefore, it is possible to perform skew correction for the subsequent recording sheet 12 during the intermittent conveyance of the preceding recording sheet 12.

In a state where a stack of recording sheets 12 are supported on the feed tray 20, a top recording sheet 12 is fed at the first feeding speed (e.g., 2 ips) when being separated from the other recording sheets 12. Therefore, it is possible to more certainly separate the top recording sheet 12 from the other recording sheets 12. Thus, it is possible to prevent multi-feed of two or more recording sheets 12.

The feeding speed for the subsequent recording sheet 12 is changed from the first feeding speed to the second feeding speed substantially at a timing when sheet conveyance ahead of image recording for the final pass is completed in the intermittent conveyance of the preceding recording sheet 12. Therefore, it is possible to more certainly prevent the subsequent recording sheet 12 from coming into contact with the preceding recording sheet 12.

Before the feeding speed for the subsequent recording sheet 12 is changed from the first feeding speed to the second feeding speed, the controller 130 determines whether the trailing end of the preceding recording sheet 12 has passed through the nip position 57. When determining that the trailing end of the preceding recording sheet 12 has not passed through the nip position 57, the controller 130 stops feeding of the subsequent recording sheet 12. Therefore, it is possible to more certainly prevent the subsequent recording sheet 12 from coming into contact with the preceding recording sheet 12.

In response to stopping the feeding of the subsequent recording sheet 12, the controller 130 discharges the subsequent recording sheet 12 out of the conveyance path 65 without performing image recording thereon. Thus, the subsequent recording sheet 12, which might have come into contact with the preceding recording sheet 12, is discharged with no image recorded thereon.

In response to the preceding recording sheet 12 being conveyed over the predetermined conveyance distance (e.g., 143 mm) from the nip position 57, the controller 130 calculates the number of remaining passes of the receding recording sheet 12. Therefore, it is possible to start feeding the subsequent recording sheet 12 to be separated an appropriate distance away from the preceding recording sheet 12.

When the number of remaining passes of the (preceding) recording sheet 12 being conveyed is equal to or less than 1, the controller 130 starts feeding a subsequent recording sheet 12 from the feed tray 20 substantially at a point of time when the trailing end of the preceding recording sheet 12 has been discharged up to the particular position downstream of the recording head 39 in the conveyance direction 16. More specifically, the particular position may be 20 mm downstream of the discharge roller unit 55 in the conveyance direction 16. Therefore, it is possible to avoid complicated control for feeding the subsequent recording sheet 12.

Based on the number of remaining passes and the image data stored in the RAM 133, the controller 130 acquires a recording period of time required for remaining images to be recorded on the preceding recording sheet 12, and sets the particular waiting period of time. Namely, based on the record instruction (including recording condition) previously stored in the RAM 133, the controller 130 determines whether the remaining images to be recorded are color images or monochrome images. When determining that the remaining images to be recorded are color images, the controller 130 sets a longer waiting period of time than when the remaining images to be recorded are monochrome images. Therefore, it is possible to prevent the subsequent recording sheet 12 from colliding with the preceding recording sheet 12.

When the remaining passes of the (preceding) recording sheet 12 being conveyed include one or more blank passes, the controller 130 starts feeding a subsequent recording sheet 12 substantially at a point of time when the trailing end of the recording sheet 12 with images recorded thereon has been discharged up to the particular position downstream of the recording head 39 in the conveyance direction 16. More specifically, the particular position may be 20 mm downstream of the discharge roller unit 55 in the conveyance direction 16. Therefore, it is possible to avoid complicated control for feeding the subsequent recording sheet 12.

In response to the recording sheet 12 being conveyed to a recording position for a next single pass before the carriage 23 begins to be moved over the next single pass, the controller 130 calculates the number of remaining passes. In other words, in response to the printer 11 being ready to start moving the carriage 23 to perform image recording for the next single pass, the controller 130 calculates the number of remaining passes. Therefore, it is possible to reduce the number of times that the controller 130 calculates the number of remaining passes, in comparison with when the controller 130 is configured to calculate the number of remaining passes every time regardless of whether the recording sheet 12 is conveyed to the recording position for the next single pass.

Before beginning to feed the recording sheet 12, the sheet feeder 15 is driven at a lower drive speed than when feeding the recording sheet 12 at the first feeding speed (e.g., 2 ips). Thereby, it is possible to release a backlash of the one or more gears included in the sheet feeder 15 before starting sheet feeding. At this time, the recording sheet 12 may be fed at the third feeding speed (e.g., 1 ips) lower than the first feeding speed. In this case, the recording sheet 12 begins to be fed at a lower feeding speed than when the sheet feeder 15 is configured to start feeding the recording sheet 12 without releasing the backlash. Thus, it is possible to prevent multi-feed of two or more recording sheets 12.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

[Modifications]

In the aforementioned illustrative embodiment, the image recording process is applied to when A4-size recording sheets are fed. However, the image recording process may be applied to when recording sheets of different sizes (e.g., B4 and B5) from A4 size. In this case, a different feeding speed and/or a different particular waiting period of time suitable for a different sheet size may be employed.

In the aforementioned illustrative embodiment, the feeding speed for a subsequent recording sheet 12 is changed from the first feeding speed to the second feeding speed, based on the lapse of a period of time from a time when the subsequent recording sheet 12 begins to be fed until a time when sheet conveyance ahead of image recording for the final pass on a preceding recording sheet 12 is completed. Nonetheless, the controller 130 may determine a timing at which the sheet conveyance ahead of image recording for the final pass on the preceding recording sheet 12 is completed, by counting the number of remaining passes of the preceding recording sheet 12. In this case, the feeding speed for the subsequent recording sheet 12 may be changed from the first feeding speed to the second feeding speed at the determined timing.

In the aforementioned illustrative embodiment, the same feeding speeds are used between color image recording and monochrome image recording. Nonetheless, different feeding speeds may be used between color image recording and monochrome image recording.

In the aforementioned illustrative embodiment, the different particular waiting periods of time are used to determine a timing to start feeding a subsequent recording sheet 12, depending on whether image recording for the remaining passes of a preceding recording sheet 12 is color image recording or monochrome image recording. However, the particular waiting period of time may be determined in different methods. For instance, the controller 130 may calculate a recording period of time required for the image recording for the remaining passes of the preceding recording sheet 12, based on a factor other than whether the image recording for the remaining passes of the preceding recording sheet 12 is color image recording or monochrome image recording. In this case, the controller 130 may set a particular waiting period of time based on the calculated recording period of time. Specifically, for instance, the recording period of time may be calculated using an image recording range of each pass in the scanning direction. Further, for instance, the recording period of time may be calculated based on whether the remaining passes include a blank pass.

In the aforementioned illustrative embodiment, the feeding speed for a recording sheet 12 is changed from the first feeding speed to the second feeding speed while the recording sheet 12 is being fed. However, the feeding speed may not necessarily be changed while the recording sheet 12 is being fed. The feeding speed may be constant while the recording sheet 12 is being fed.

As exemplified in the aforementioned illustrative embodiment, the image recording process may be performed by the CPU 131 executing one or more programs 132A stored in the ROM 132. Nonetheless, the image recording process may be executed in whole or part by one or more hardware elements (e.g., one or more processors, one or more ASICs, and a combination of one or more processors and one or more ASICs) in cooperation with each other.

What is claimed is:

1. An inkjet printer comprising:

a tray configured to support a plurality of sheets placed thereon;

a feeder configured to feed each sheet from the tray to a conveyance path;

a conveyor configured to convey each sheet in a conveyance direction along the conveyance path;

a recording head configured to discharge ink droplets onto each sheet conveyed by the conveyor;

a carriage configured to reciprocate along a scanning direction with the recording head mounted thereon, the scanning direction being perpendicular to the conveyance direction;

a carriage moving mechanism configured to move the carriage along the scanning direction;

a storage configured to store image data to be recorded on each sheet; and a controller configured to perform:

an intermittent conveyance process comprising:

controlling the conveyor to intermittently convey a preceding sheet by alternately repeating conveyance and stop of the preceding sheet;

an image recording process comprising:

controlling the recording head to perform image recording for each single pass on the preceding sheet by discharging ink droplets onto the preceding sheet while controlling the carriage moving mechanism to move the carriage over each single pass in a single direction along the scanning direction, based on the image data stored in the storage, in the intermittent conveyance process;

a remaining-pass calculating process comprising:

calculating a count of remaining passes to be recorded on the preceding sheet in the image recording process, based on the image data stored in the storage; and a feeding process comprising:

in response to the calculated count of the remaining passes being a particular number greater than 1, controlling the feeder to start feeding a subsequent sheet from the tray at a point of time when a first particular period of time elapses from a next timing to start conveyance of the preceding sheet in the intermittent conveyance process, wherein the controller is further configured to perform a time setting process comprising:

acquiring an image-recording period of time required for image recording for the remaining passes to be recorded on the preceding sheet in the image recording process, based on the calculated count of the remaining passes and the image data stored in the storage; and setting the first particular period of time based on the acquired image-recording period of time.

2. The inkjet printer according to claim 1, wherein the conveyor comprises two conveyance rollers disposed to face each other in a nip position upstream of the recording head in the conveyance direction, and wherein the controller is further configured to perform a registration process comprising:

correcting skew of the subsequent sheet fed from the tray by bringing a leading end of the subsequent sheet in the conveyance direction into contact with the nip position between the two conveyance rollers that have been stopped in the intermittent conveyance process for the preceding sheet.

3. The inkjet printer according to claim 1, wherein the feeding process further comprises:

controlling the feeder to feed the subsequent sheet at a first feeding speed from a time when the subsequent sheet begins to be fed until a time when a second particular period of time elapses therefrom; and controlling the feeder to feed the subsequent sheet at a second feeding speed at a point of time when the second particular period of time elapses, the second feeding speed being higher than the first feeding speed.

4. The inkjet printer according to claim 3, wherein the second particular period of time is a period of time from a time when the subsequent sheet begins to be fed until a time when sheet conveyance ahead of image recording for a final pass on the preceding sheet is completed in the intermittent conveyance process.

5. The inkjet printer according to claim 3, wherein the feeding process further comprises:

before controlling the feeder to feed the subsequent sheet at the second feeding speed, determining whether a trailing end of the preceding sheet in the conveyance direction has passed through the conveyor; and in response to determining that the trailing end of the preceding sheet in the conveyance direction has not passed through the conveyor, controlling the feeder to stop feeding the subsequent sheet.

6. The inkjet printer according to claim 5, wherein the feeding process further comprises:

in response to controlling the feeder to stop feeding the subsequent sheet, after completion of image recording on the preceding sheet, discharging the subsequent sheet out of the conveyance path without performing image recording on the subsequent sheet.

7. The inkjet printer according to claim 3, wherein the feeding process further comprises:

before beginning to feed the subsequent sheet, driving the feeder at a lower drive speed than when feeding the subsequent sheet at the first feeding speed.

8. The inkjet printer according to claim 1, further comprising a sensor configured to detect a sheet in a position on the conveyance path that is upstream of the conveyor in the conveyance direction, wherein the feeding process further comprises:

controlling the feeder to continue to feed the subsequent sheet until the subsequent sheet is detected by the sensor.

9. The inkjet printer according to claim 1, wherein the controller is further configured to perform a conveyance-distance measuring process comprising:

measuring a conveyance distance over which the preceding sheet is conveyed by the conveyor in the intermittent conveyance process, and wherein the remaining-pass calculating process further comprises:

in response to the measured conveyance distance being equal to or more than a particular conveyance distance, calculating the count of the remaining passes to be recorded on the preceding sheet in the image recording process.

10. The inkjet printer according to claim 9, wherein when the measured conveyance distance is equal to or more than the particular conveyance distance, a trailing end of the preceding sheet in the conveyance direction is fed out of the tray.

11. The inkjet printer according to claim 1, wherein the feeding process further comprises:

in response to the calculated count of the remaining passes being equal to or less than 1, controlling the feeder to start feeding the subsequent sheet from the tray at a point of time when a trailing end of the preceding sheet in the conveyance direction is conveyed to a particular position downstream of the recording head in the conveyance direction.

12. The inkjet printer according to claim 11, wherein the conveyor comprises a discharge roller disposed downstream of the recording head in the conveyance direction, and wherein the particular position is downstream of the discharge roller in the conveyance direction.

13. The inkjet printer according to claim 1, wherein the remaining-pass calculating process further comprises:

in response to the preceding sheet being conveyed to a recording position for a next single pass before the carriage begins to be moved over the next single pass, calculating the count of the remaining passes.

14. The inkjet printer according to claim 1, wherein the conveyor comprises two conveyance rollers disposed to face each other in a nip position upstream of the recording head in the conveyance direction, and wherein at the point of time when the first particular period of time elapses from the next timing to start conveyance of the preceding sheet in the intermittent conveyance process, a leading end of the subsequent sheet in the conveyance direction is fed to the nip position between the two conveyance rollers during execution of image recording for a final pass on the preceding sheet.

15. An inkjet printer comprising:

a tray configured to support a plurality of sheets placed thereon;

a feeder configured to feed each sheet from the tray to a conveyance path;

a conveyor configured to convey each sheet in a conveyance direction along the conveyance path;

a recording head configured to discharge ink droplets onto each sheet conveyed by the conveyor;

a carriage configured to reciprocate along a scanning direction with the recording head mounted thereon, the scanning direction being perpendicular to the conveyance direction;

a carriage moving mechanism configured to move the carriage along the scanning direction;

a storage configured to store image data to be recorded on each sheet; and a controller configured to perform:

an intermittent conveyance process comprising:

controlling the conveyor to intermittently convey a preceding sheet by alternately repeating conveyance and stop of the preceding sheet;

an image recording process comprising:

controlling the recording head to perform image recording for each single pass on the preceding sheet by discharging ink droplets onto the preceding sheet while controlling the carriage moving mechanism to move the carriage over each single pass in a single direction along the scanning direction, based on the image data stored in the storage, in the intermittent conveyance process;

a remaining-pass calculating process comprising:

calculating a count of remaining passes to be recorded on the preceding sheet in the image recording process, based on the image data stored in the storage; and a feeding process comprising:

in response to the calculated count of the remaining passes being a particular number, controlling the feeder to start feeding a subsequent sheet from the tray at a point of time when a first particular period of time elapses from a next timing to start conveyance of the preceding sheet in the intermittent conveyance process, wherein the controller is further configured to perform a time setting process comprising:

acquiring an image-recording period of time required for image recording for the remaining passes to be recorded on the preceding sheet in the image recording process, based on the calculated count of the remaining passes and the image data stored in the storage; and setting the first particular period of time based on the acquired image-recording period of time, wherein the time setting process further comprises:

determining whether the image recording for the remaining passes is unidirectional image recording or bidirectional image recording, based on recording condition previously stored in the storage, the unidirectional image recording for each single pass being performed only when the carriage is moving in a particular single direction along the scanning direction, the bidirectional image recording for each single pass being performed when the carriage is moving in a corresponding one of both directions along the scanning direction, and in response to determining that the image recording for the remaining passes is unidirectional image recording, setting a particular period of time longer than for the bidirectional image recording, as the first particular period of time.

16. An inkjet printer comprising:

a tray configured to support a plurality of sheets placed thereon;

a feeder configured to feed each sheet from the tray to a conveyance path;

a conveyor configured to convey each sheet in a conveyance direction along the conveyance path;

a recording head configured to discharge ink droplets onto each sheet conveyed by the conveyor;

a carriage configured to reciprocate along a scanning direction with the recording head mounted thereon, the scanning direction being perpendicular to the conveyance direction;

a carriage moving mechanism configured to move the carriage along the scanning direction;

a storage configured to store image data to be recorded on each sheet; and a controller configured to perform:

an intermittent conveyance process comprising:

controlling the conveyor to intermittently convey a preceding sheet by alternately repeating conveyance and stop of the preceding sheet;

an image recording process comprising:

controlling the recording head to perform image recording for each single pass on the preceding sheet by discharging ink droplets onto the preceding sheet while controlling the carriage moving mechanism to move the carriage over each single pass in a single direction along the scanning direction, based on the image data stored in the storage, in the intermittent conveyance process;

a remaining-pass calculating process comprising:

calculating a count of remaining passes to be recorded on the preceding sheet in the image recording process, based on the image data stored in the storage; and a feeding process comprising:

in response to the calculated count of the remaining passes being a particular number, controlling the feeder to start feeding a subsequent sheet from the tray at a point of time when a first particular period of time elapses from a next timing to start conveyance of the preceding sheet in the intermittent conveyance process, wherein the intermittent conveyance process further comprises:

when the remaining passes to be recorded on the preceding sheet include a blank pass, controlling the conveyor to convey the preceding sheet over a distance as long as the blank pass in the conveyance direction, the blank pass being such a pass that a blank area thereof having no image to be recorded over a whole length of the preceding sheet in the scanning direction is longer than an ink dischargeable area of the recording head, in the conveyance direction, and wherein the feeding process further comprises:

after completion of image recording for the remaining passes including the blank pass, controlling the feeder to start feeding the subsequent sheet from the tray at a point of time when a trailing end of the preceding sheet in the conveyance direction is conveyed to a particular position downstream of the recording head in the conveyance direction.

17. The inkjet printer according to claim 16, wherein the conveyor comprises a discharge roller disposed downstream of the recording head in the conveyance direction, and wherein the particular position is downstream of the discharge roller in the conveyance direction.

18. A method implementable on a processor coupled with an inkjet printer comprising a tray, a feeder, a conveyor, a carriage, a recording head mounted on the carriage, a carriage moving mechanism, and a storage, the method comprising:

performing an intermittent conveyance process comprising:

controlling the conveyor to intermittently convey a preceding sheet in a conveyance direction by alternately repeating conveyance and stop of the preceding sheet;

performing an image recording process comprising:

controlling the recording head to perform image recording for each single pass on the preceding sheet by discharging ink droplets onto the preceding sheet while controlling the carriage moving mechanism to move the carriage over each single pass in a single direction along a scanning direction, based on image data stored in the storage, in the intermittent conveyance process, the scanning direction being perpendicular to the conveyance direction;

performing a remaining-pass calculating process comprising:

calculating a count of remaining passes to be recorded on the preceding sheet in the image recording process, based on the image data stored in the storage;

performing a feeding process comprising:

in response to the calculated count of the remaining passes being a particular number, controlling the feeder to start feeding a subsequent sheet from the tray at a point of time when a first particular period of time elapses from a next timing to start conveyance of the preceding sheet in the intermittent conveyance process; and performing a time setting process comprising:

acquiring an image-recording period of time required for image recording for the remaining passes to be recorded on the preceding sheet in the image recording process, based on the calculated count of the remaining passes and the image data stored in the storage; and setting the first particular period of time based on the acquired image-recording period of time.

19. A non-transitory computer-readable medium storing computer-readable instructions executable on a processor coupled with an inkjet printer comprising a tray, a feeder, a conveyor, a carriage, a recording head mounted on the carriage, a carriage moving mechanism, and a storage, the instructions being configured to, when executed by the processor, cause the processor to perform:

an intermittent conveyance process comprising:

controlling the conveyor to intermittently convey a preceding sheet in a conveyance direction by alternately repeating conveyance and stop of the preceding sheet;

an image recording process comprising:

controlling the recording head to perform image recording for each single pass on the preceding sheet by discharging ink droplets onto the preceding sheet while controlling the carriage moving mechanism to move the carriage over each single pass in a single direction along a scanning direction, based on image data stored in the storage, in the intermittent conveyance process, the scanning direction being perpendicular to the conveyance direction;

a remaining-pass calculating process comprising:

calculating a count of remaining passes to be recorded on the preceding sheet in the image recording process, based on the image data stored in the storage;

a feeding process comprising:

in response to the calculated count of the remaining passes being a particular number, controlling the feeder to start feeding a subsequent sheet from the tray at a point of time when a first particular period of time elapses from a next timing to start conveyance of the preceding sheet in the intermittent conveyance process; and a time setting process comprising:

acquiring an image-recording period of time required for image recording for the remaining passes to be recorded on the preceding sheet in the image recording process, based on the calculated count of the remaining passes and the image data stored in the storage; and setting the first particular period of time based on the acquired image-recording period of time.

* * * * *